US011408165B2

(12) United States Patent
Kolisnek

(10) Patent No.: US 11,408,165 B2
(45) Date of Patent: Aug. 9, 2022

(54) MODULAR PROTECTIVE ENCLOSURE FOR OUTDOOR EQUIPMENT

(71) Applicant: Kurtis Kolisnek, Airdrie (CA)

(72) Inventor: Kurtis Kolisnek, Airdrie (CA)

( * ) Notice: Subject to any disclaimer, the term of this patent is extended or adjusted under 35 U.S.C. 154(b) by 0 days.

(21) Appl. No.: 16/908,844

(22) Filed: Jun. 23, 2020

(65) Prior Publication Data

US 2021/0396001 A1 Dec. 23, 2021

(51) Int. Cl.
*E04B 1/343* (2006.01)
*E04H 1/12* (2006.01)
*E04H 5/02* (2006.01)

(52) U.S. Cl.
CPC ..... *E04B 1/34321* (2013.01); *E04H 1/1205* (2013.01); *E04H 5/02* (2013.01)

(58) Field of Classification Search
CPC ..... E04B 1/34321; E04H 1/1205; E04H 5/02; E04H 5/04
USPC ..... 52/79.1
See application file for complete search history.

(56) References Cited

U.S. PATENT DOCUMENTS 2,765,500 A * 10/1956 Campus ..... E04B 1/34321 52/91.1
3,236,014 A * 2/1966 Norman ..... E04B 1/14 52/270
3,546,831 A * 12/1970 Kratky ..... E04B 1/34321 52/115
3,675,379 A 7/1972 Lambert et al.
3,827,201 A * 8/1974 Struben ..... E04B 1/34342 52/155
3,886,699 A * 6/1975 Bergmann, Jr. ..... E04C 2/205 52/91.1
4,125,972 A * 11/1978 Pate ..... E04B 1/14 52/220.2
4,389,948 A * 6/1983 Sands ..... E04H 1/125 109/82
4,512,120 A * 4/1985 Lindal ..... E04B 1/34321 52/143
4,570,392 A * 2/1986 Oltman ..... E04H 1/1205 52/64
4,588,190 A * 5/1986 Stewart ..... A63B 69/0097 273/395
4,919,210 A * 4/1990 Schaefer, Jr. ..... E21B 33/037 166/356
4,964,252 A 10/1990 Guliker
5,033,489 A * 7/1991 Ferre ..... B60S 3/008 134/57 R
5,293,725 A 3/1994 Matticks et al.
(Continued)

*Primary Examiner* — Brian D Mattei
*Assistant Examiner* — Joseph J. Sadlon
(74) *Attorney, Agent, or Firm* — Lewellyn Law, PLLC; Stephen Lewellyn

(57) ABSTRACT

A protective enclosure for equipment located outside, such as, for example pipeline and wellhead valves, includes a plurality of modular panels that are releasably connectable to form the enclosure into a configuration necessary to enclose and protect the equipment from the weather. The modular panels are metal structural panels having a rigid foam core to provide a desired level of insulation rating to the enclosure. In embodiments, the modular panels are configured to be assembled into one or more of a roof assembly, a gable assembly, and one or more sidewall assemblies. Assembly securing members attach the various modular panels together in a manner so as to prevent separation in a plurality of directions.

13 Claims, 18 Drawing Sheets

(56) References Cited

U.S. PATENT DOCUMENTS 5,331,778 A 7/1994 Mazpule et al.
5,417,539 A * 5/1995 van der Wal ..... E04B 1/34336 280/483
5,424,118 A * 6/1995 McLaughlin ..... E05C 3/004 428/318.6
5,651,219 A * 7/1997 Baloga ..... A47B 83/001 52/36.1
5,657,583 A * 8/1997 Tennant ..... E04B 1/34321 52/270
5,724,774 A * 3/1998 Rooney ..... E04B 1/34321 52/36.2
5,921,047 A 7/1999 Walker
5,960,592 A 10/1999 Lilienthal, II et al.
6,305,131 B1 * 10/2001 Romig ..... B09B 1/00 588/259
6,349,510 B1 2/2002 Haas et al.
6,561,215 B1 5/2003 Wakefield
6,786,009 B1 * 9/2004 McGunn ..... A47B 47/03 312/263
6,802,158 B1 * 10/2004 Greene ..... E04H 1/1205 52/270
6,892,497 B2 * 5/2005 Moon ..... E04B 1/34321 52/270
6,948,280 B2 * 9/2005 Marcinkowski .... E04B 1/34321 52/79.5
7,003,863 B2 * 2/2006 Skov ..... A47F 5/0815 29/453
7,076,922 B1 * 7/2006 Parres ..... E04B 1/8218 52/646
7,326,355 B2 * 2/2008 Graetz ..... A61M 1/0236 141/10
8,156,690 B2 * 4/2012 Higley ..... E04B 1/12 52/79.5
8,429,857 B2 * 4/2013 Melrose ..... E04H 9/10 52/79.1
8,683,753 B2 * 4/2014 Bachorz ..... E04B 1/80 52/79.5
9,222,250 B2 * 12/2015 Peterson ..... E04B 1/3445
9,376,801 B1 * 6/2016 Warren ..... E04H 5/02
9,970,207 B2 * 5/2018 Wasson ..... E04H 1/02
10,662,662 B2 * 5/2020 Baker ..... A47K 4/00
10,663,090 B2 * 5/2020 Paetow ..... F16L 5/04
10,837,168 B2 * 11/2020 Rittmanic ..... E04B 1/34861
10,889,984 B2 * 1/2021 Arguin ..... E04F 13/0894
11,149,430 B2 * 10/2021 Segall ..... E04C 2/386
2001/0010137 A1 * 8/2001 Jimenez Sanchez ..... E04H 1/1238 52/79.1
2002/0046521 A1 * 4/2002 Steinacker, Sr. ..... E04C 2/044 52/274
2006/0048459 A1 * 3/2006 Moore ..... E04B 1/34321 52/79.1
2007/0096505 A1 * 5/2007 Haack ..... B60P 3/34 296/165
2007/0289636 A1 12/2007 Chitwood et al.
2008/0110484 A1 5/2008 Doran
2011/0289860 A1 12/2011 Wilson
2012/0073215 A1 * 3/2012 Zhang ..... F02C 7/24 52/79.9
2014/0182220 A1 * 7/2014 Hunt ..... C08G 14/10 52/79.9
2019/0234536 A1 * 8/2019 Paetow ..... H02G 3/22

* cited by examiner

MODULAR PROTECTIVE ENCLOSURE FOR OUTDOOR EQUIPMENT

FIELD OF THE INVENTION

The present disclosure relates to enclosures for protecting equipment located outdoors, and more particularly to a protective enclosure having a modular construction.

BACKGROUND OF THE INVENTION

Certain equipment is installed outside, for example, wellheads and pipelines having valves. In cold climates, such equipment must be protected from exposure to prevent failing. In the pipeline and wellhead valve example, the current practice is to enclose the valve in plastic sheeting that is supported by a frame. The interior space created by the sheeting is then heated with large BTU portable heaters that are expensive to operate. The plastic sheeting enclosure often fails due to tearing caused by wind and/or snow and ice accumulating on the sheeting. Accordingly, there is a need and a desire for a new enclosure for protecting pipeline and wellhead valves and other equipment that is located outside in cold climates.

SUMMARY OF THE INVENTION

The present disclosure describes a portable, modular enclosure and system comprising metal structural panels having a rigid foam core. The enclosure and system that is configured to have limitless assemblies to provide an enclosure for equipment of various construction that are located outside and need protection from the weather. The enclosure is assembled at the equipment site and according to a configuration necessary to properly enclose and protect the equipment. As a non-limiting example, the equipment can be a pipeline valve or wellhead with one or more valves having long valve stems that move vertically during operation.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. The same reference numeral may be used to indicate a similar feature or a feature with similar functionality. In the drawings.

DETAILED DESCRIPTION OF THE INVENTION

Figure 1:
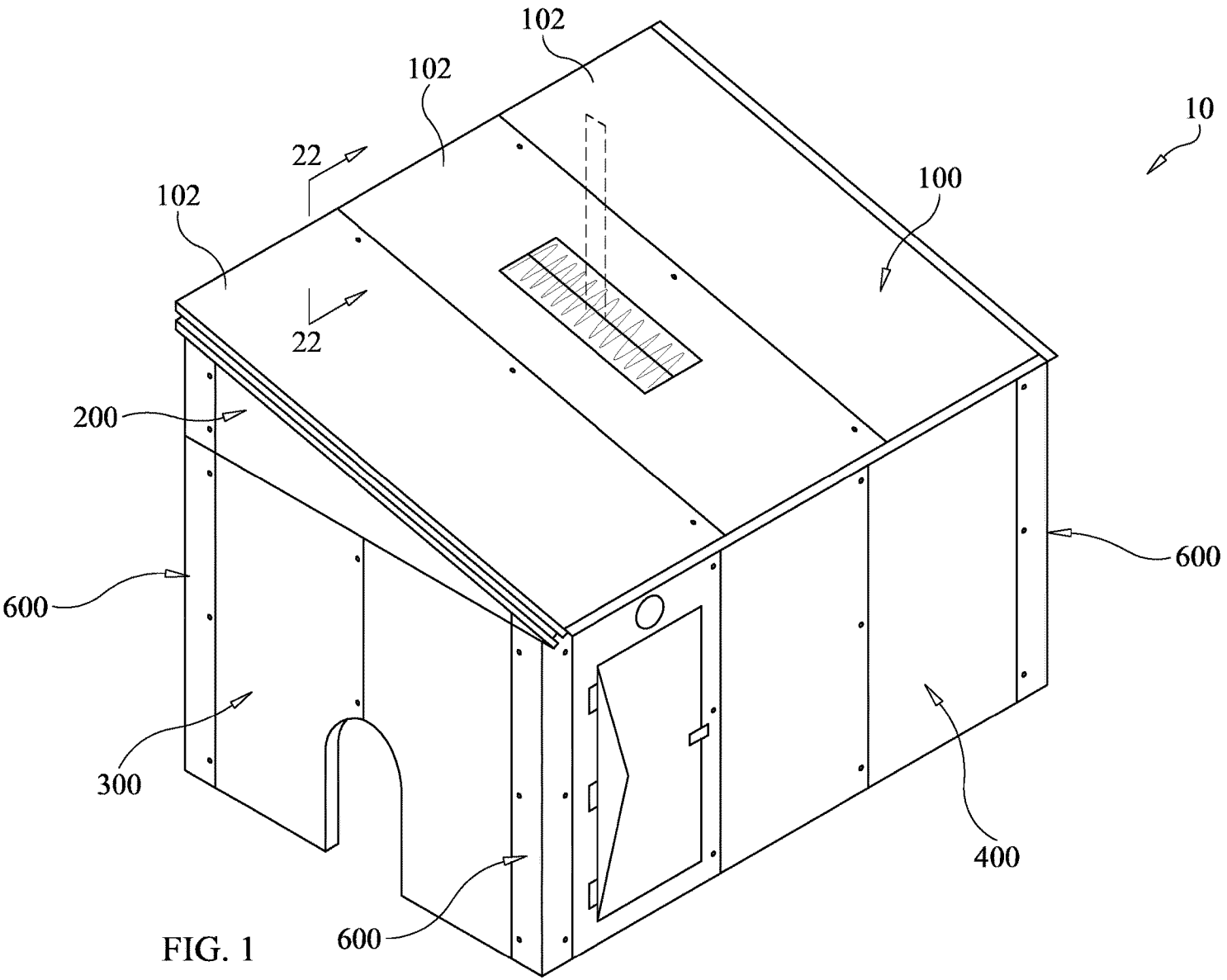
FIG. 1 is a perspective view of one embodiment of a protective enclosure constructed in accordance with the invention.

Reference now will be made in detail to embodiments of the invention, one or more examples of which are illustrated in the drawings. It will be readily understood that the components of the present invention, as generally described and illustrated in the drawings herein, could be arranged and designed in a wide variety of different configurations Thus, the following more detailed description of the embodiments of the assembly is not intended to limit the scope of the invention, as claimed, but it is merely representative of the presently preferred embodiments of the invention. It is intended that the present invention covers modifications and variations as come within the scope of the appended claims and their equivalents.

Figure 2:
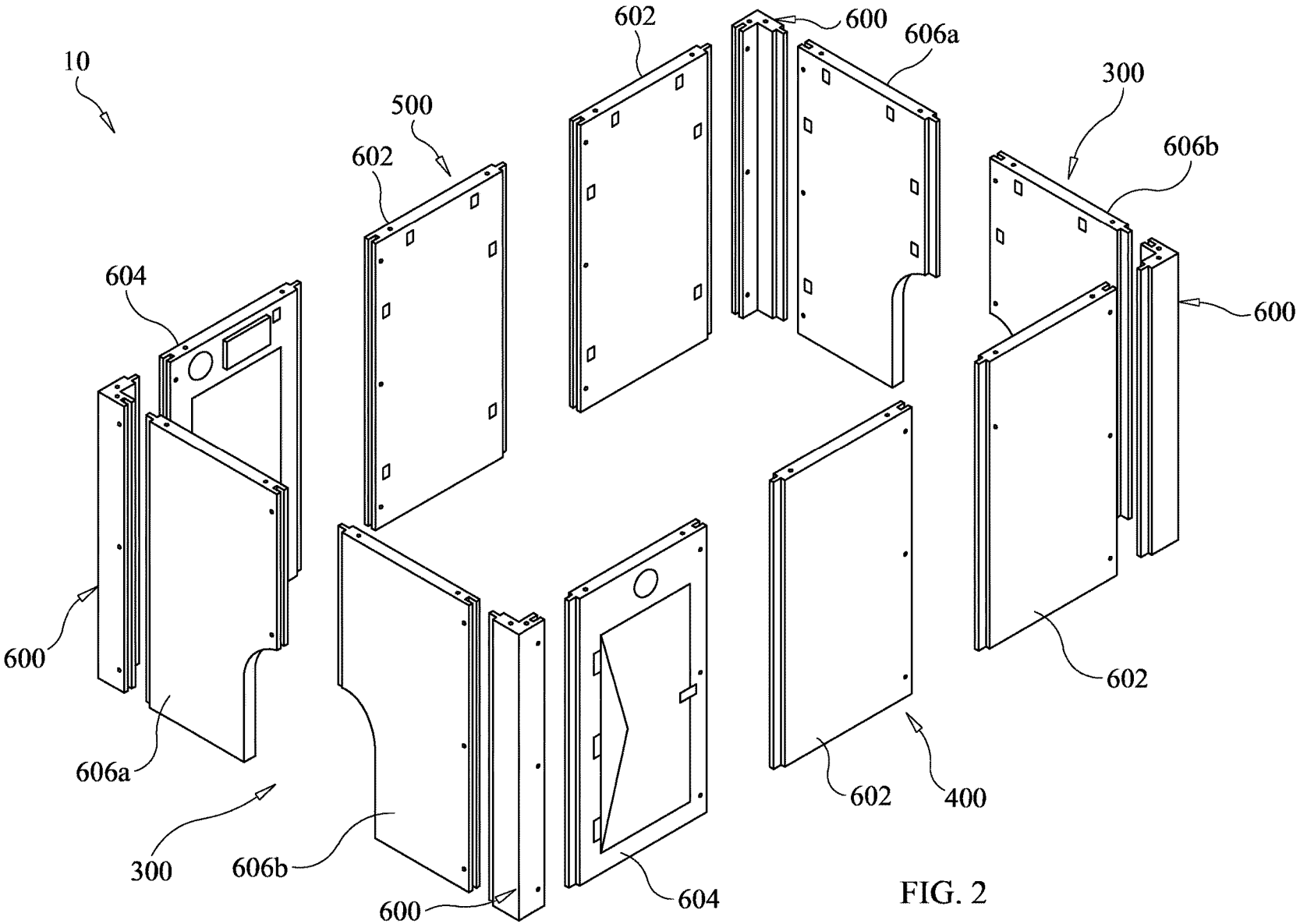
FIG. 2 is a partial, perspective exploded view of the enclosure of FIG. 1.
Figure 3:
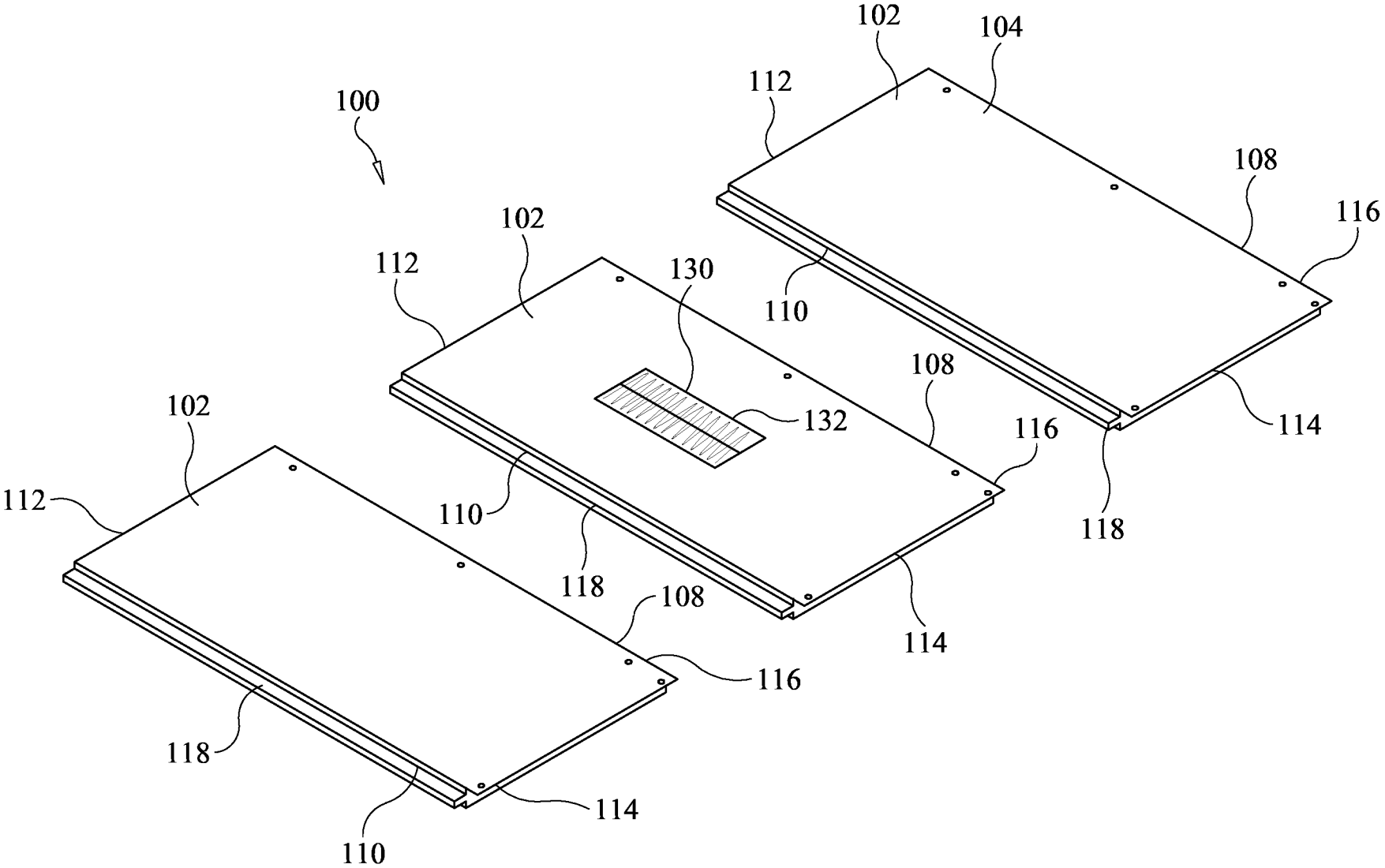
FIG. 3 is an exploded view of an embodiment of a roof assembly of the protective enclosure.
Figure 4:
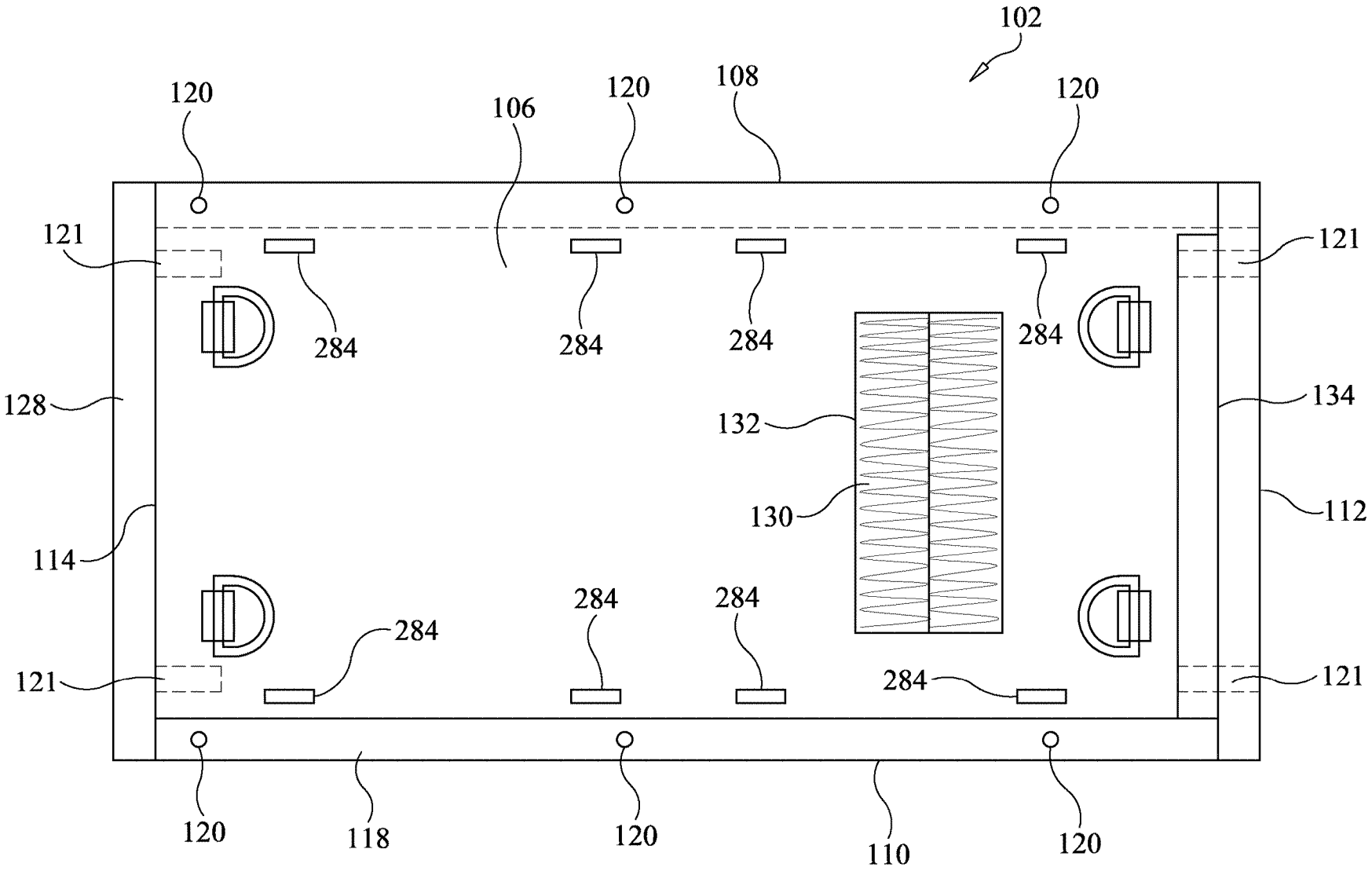
FIG. 4 is an interior view of one embodiment of a roof panel member of the protective enclosure.
Figure 5:
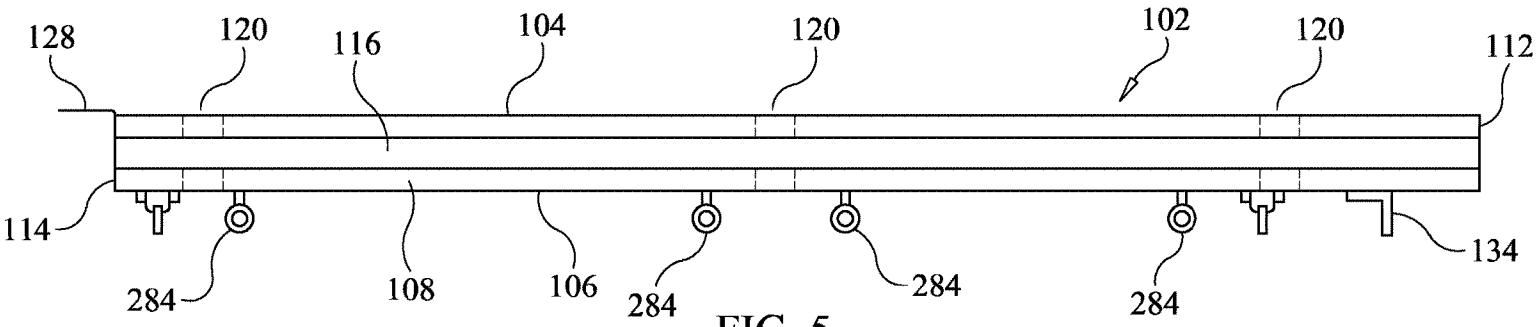
FIG. 5 is a first side view of one embodiment of a roof panel member of the protective enclosure.
Figure 6:
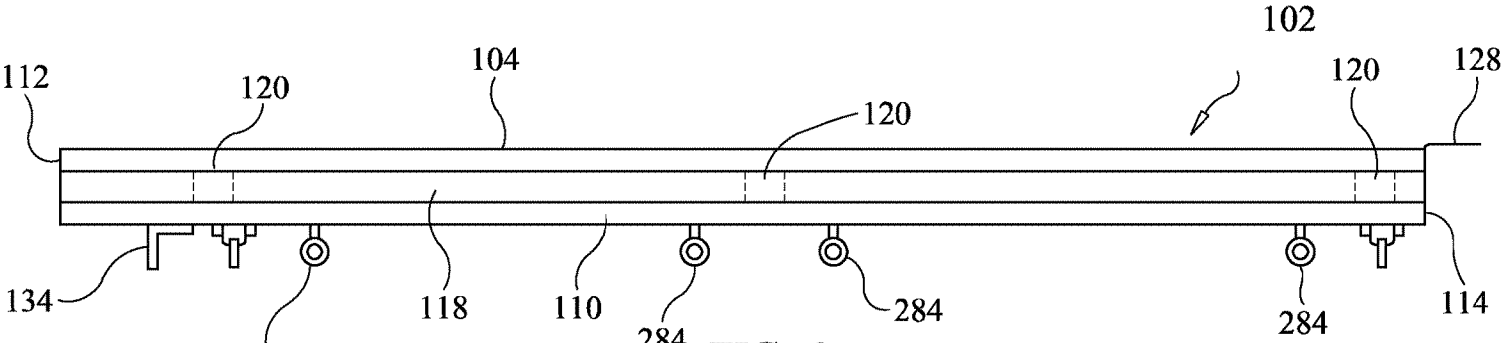
FIG. 6 is a second side view of one embodiment of a roof panel member of the protective enclosure.
Figure 8:
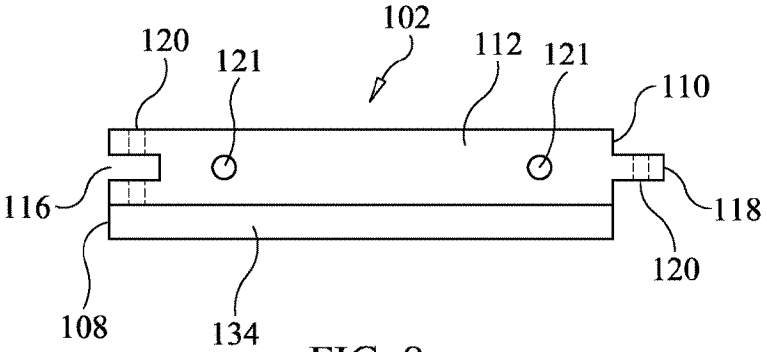
FIG. 8 is a second end view of one embodiment of a roof panel member of the protective enclosure.
Figure 7:
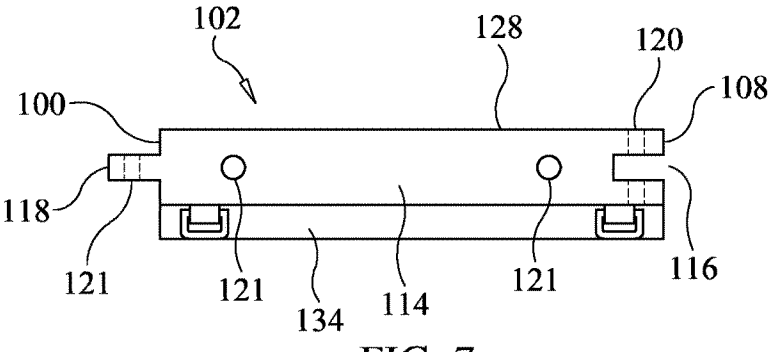
FIG. 7 is first end view of one embodiment of a roof panel member of the protective enclosure.

Referring to FIGS. 1-2, one embodiment of a protective enclosure system using modular, panels is shown and generally designated reference number 10. In the illustrated embodiment, enclosure 10 is constructed to protect a pipeline having a valve (not shown). The present disclosure is not limited to enclosures for protecting pipeline valves but can be employed to protect various equipment that is stored outside. An important aspect of the present disclosure is the modularity of the panels that allow for constructing enclosures of various sizes and shapes as desired to cover different equipment.

The enclosure includes a roof assembly 100, a gable assembly 200, and a plurality of sidewall assemblies, representatively shown comprising left and right sidewall assemblies 300, a front wall assembly 400, and a rear wall assembly 500, and a plurality of wall corner connector panels 600. In the preferred embodiment, the panels comprising the assemblies are constructed of a rigid foam core with a metal skin or cladding enclosing the rigid foam core, thereby providing insulated panels to a desired R rating.

As further shown and described herein, the panels comprising the assemblies are connected through various connectors in such a manner as to prevent separation of the panels in a plurality of directions. In representative embodiments, adjoining vertically oriented edges of the panels may be connected through a tongue-and-groove coupling with the tongue along the edge of one panel and the groove along the edge of the other panel. Further, mechanical fasteners, such as, for example bolts may be used to tie the tongue and groove coupling together to prevent separation thereof. In some embodiments, adjoining longitudinally oriented edges of panels may be connected through a pin-in-hole coupling. Additionally, mechanical couplings, such as, for example toggle latches, can be used to pull or cinch together the juxtaposed panels to further prevent separation of the panels in a plurality of directions.

With further reference to FIGS. 3-10, the roof assembly 100 encloses a top of the enclosure and may include one or more roof panel members 102 secured together in a substantially juxtaposed coplanar relationship. While the roof assembly 100 is representatively shown having three roof panel members 102 secured together side-by-side, it will become apparent that the roof panel members may also be connected end-to-end and side-by-side to form a roof having a desire length and width. In some embodiments, depending on the length and width, roof jacks (not shown) may be positioned within the enclosure and used to provide further support to the roof span. Further, in some embodiments, a single roof panel member 102 may be used.

Each roof panel member 102 includes a broad exterior side 104, an broad interior side 106 that is spaced from said broad exterior side defining a thickness therebetween a first edge 108, a second edge 110 opposite said first edge, a third edge 112 substantially perpendicular to and extending between the first and the second edges, a fourth edge 114 opposite to and substantially parallel to the third edge, wherein the distance between the third edge and the fourth edge defines a predetermined length. The first edge 108 has a groove 116 and the second edge 110 has a tongue 118. The tongue and grooves 116 and 118 may include through holes 120 spaced therealong, respectively, for receiving bolts. Each roof panel member 102 may also include pin receiving holes 122 that are formed through the third and fourth edges 112 and 114, respectively.

Figure 9:
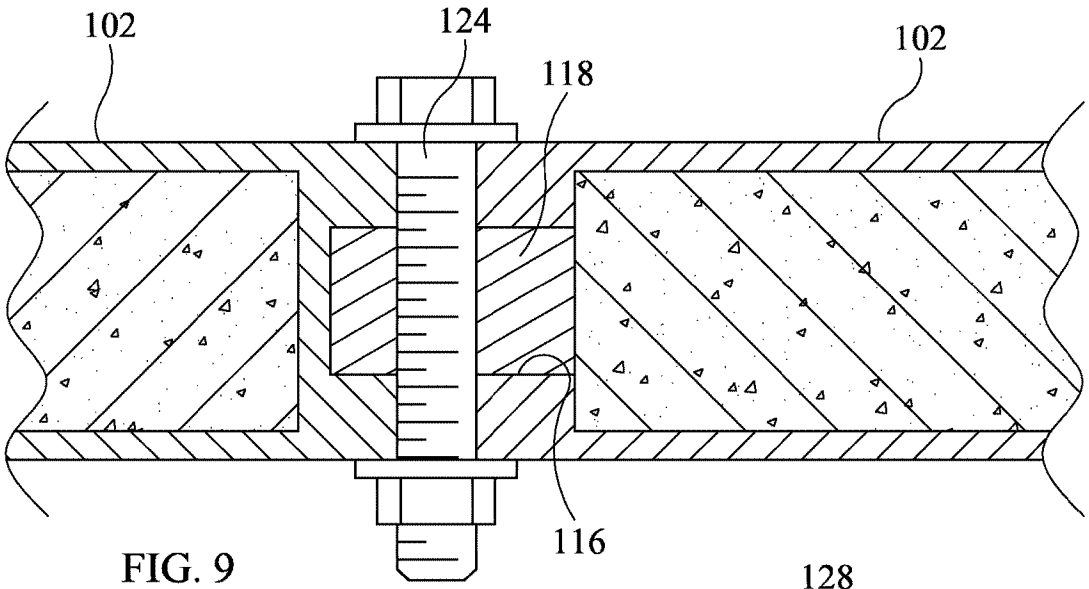
FIG. 9 is a cross-sectional view through a pair of roof panel members connected in a side-by-side coplanar relationship.
Figure 10:
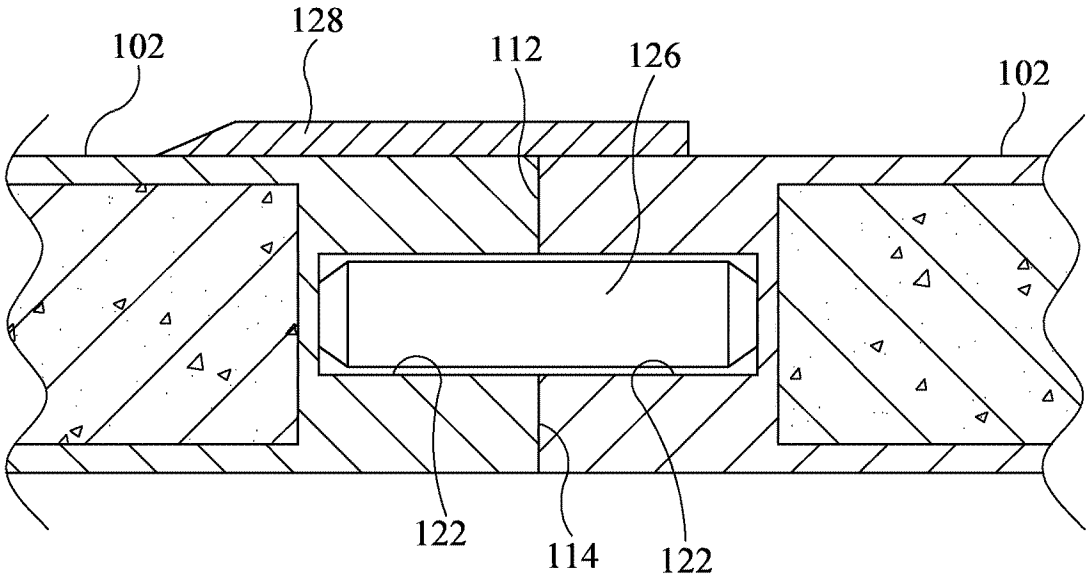
FIG. 10 is a cross-sectional view through a pair of roof panel members connected in an end-to-end coplanar relationship.

In FIG. 9, roof panel members 102 that are arranged side-by-side in a juxtaposed coplanar relationship may be connected by the tongue 118 of one panel disposed within the groove 116 of the adjoining panel. The tongue 118 can be secured in the groove 116 by one or more bolts 124 that is passed through cooperative holes 120 formed through the tongue and groove. In FIG. 10, roof panel members 102 that are arranged end-to-end in a juxtaposed coplanar relationship can be connected by one or more pins 126 received by cooperating arranged pin receiving holes 121 through edges 112 and 114, respectively. As further shown, edge 114 of roof panel members 102 may include a shiplap flange 128 to provide a lap over the adjoining roof panel member to prevent water from flowing through the adjoining edges.

As further shown in the representative embodiment, one or more roof panel members 102 may optionally include a bristle-brush seal 130 disposed within an opening 132 formed through the thickness of the panel. The seal 130 helps to prevent hot air from escaping from the interior of the protective enclosure when the roof panel is fitted with the opening 132 to allow a valve stem of a pipeline valve, for example, to extend through the opening in the roof. One or more roof panel members 102 may also have an L-shaped hanger 134 disposed on the interior broad side and along the third edge thereof so that the roof panel member can be supported at that edge during assembly of the enclosure.

Figure 11:
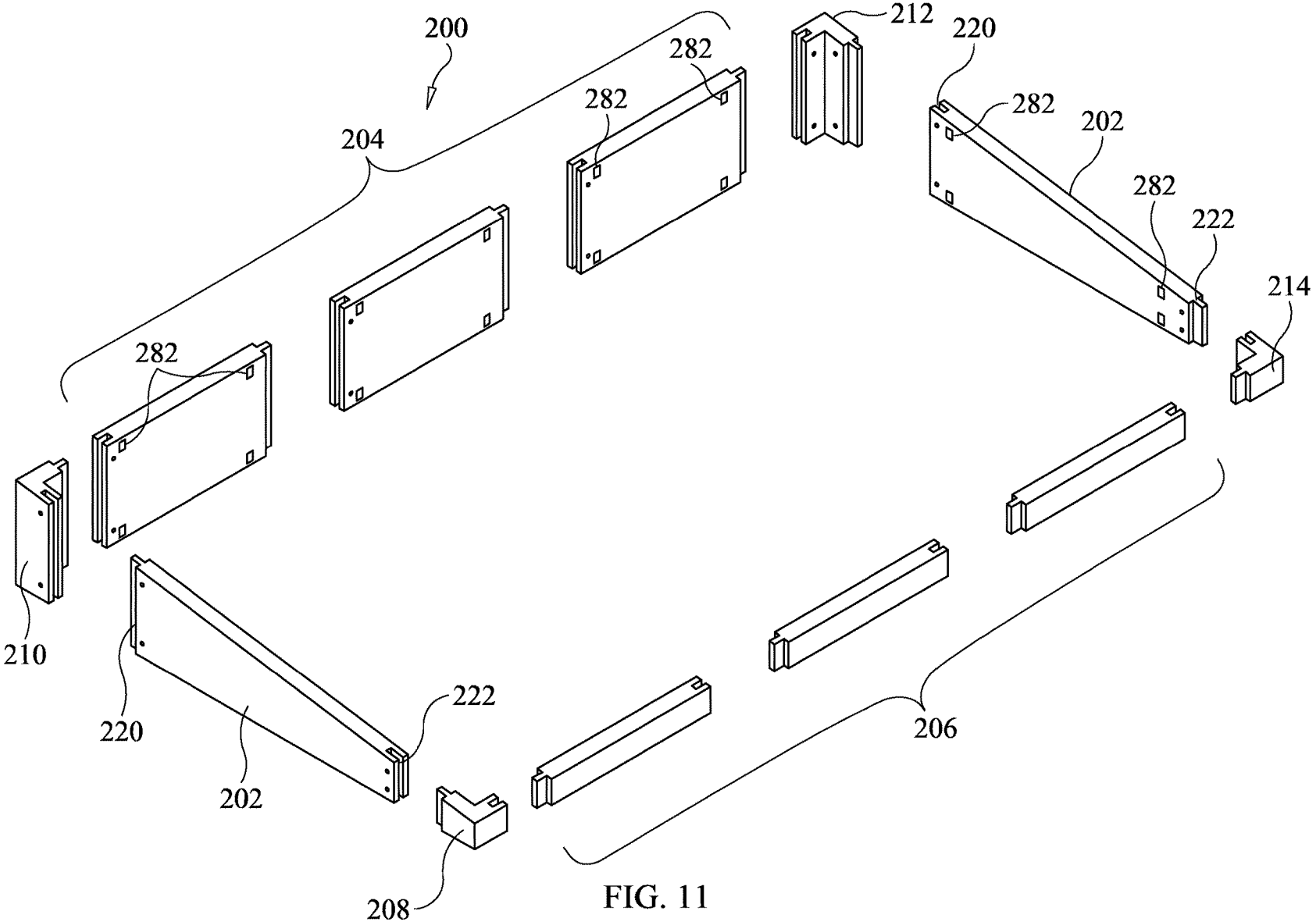
FIG. 11 is an exploded view of an embodiment of a gable assembly of the protective enclosure.
Figure 12:
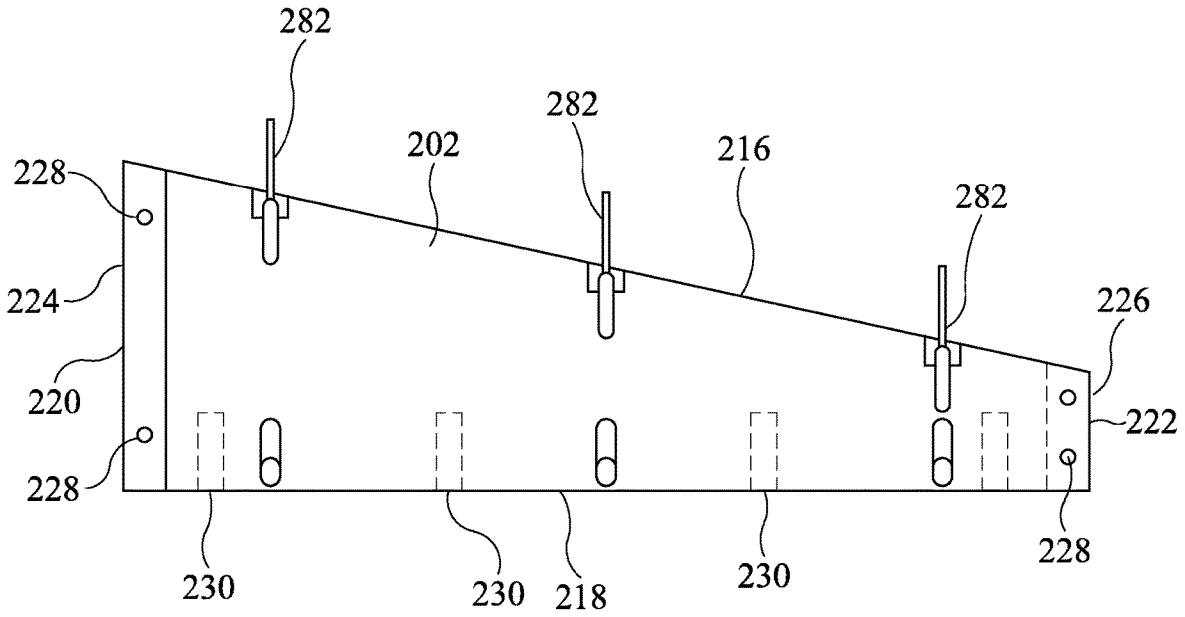
FIG. 12 is an interior view of one embodiment of a gable sidewall panel member of the protective enclosure.
Figure 13:
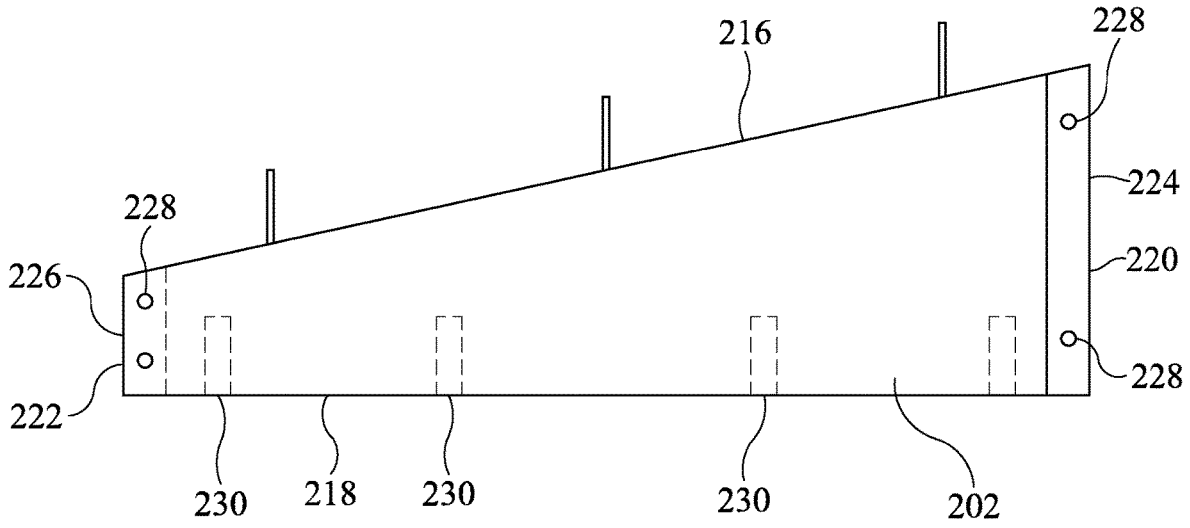
FIG. 13 is an exterior view of one embodiment of a gable sidewall panel member of the protective enclosure.
Figure 16:
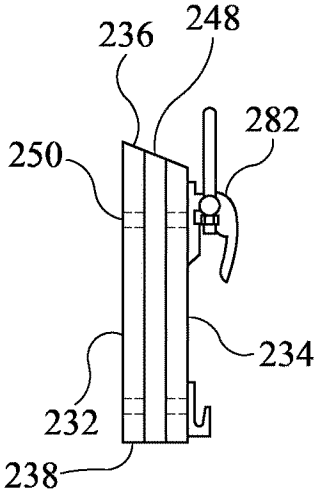
FIG. 16 is first end view of one embodiment of a tall gable riser panel of the protective enclosure.
Figure 17:
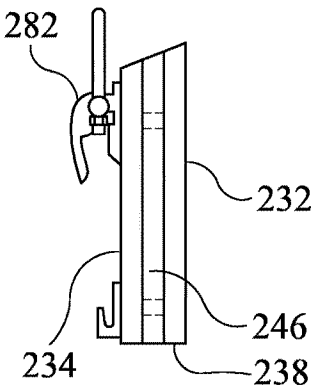
FIG. 17 is second end view of one embodiment of a tall gable riser panel of the protective enclosure.
Figure 14:
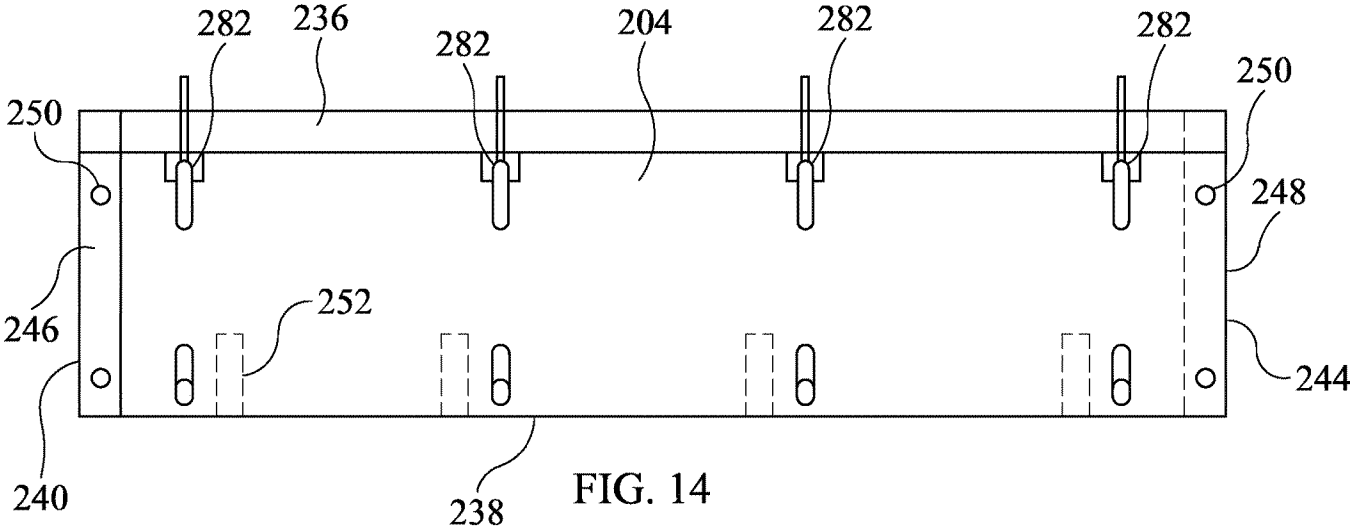
FIG. 14 is an interior view of one embodiment of a tall gable riser panel member of the protective enclosure.
Figure 15:
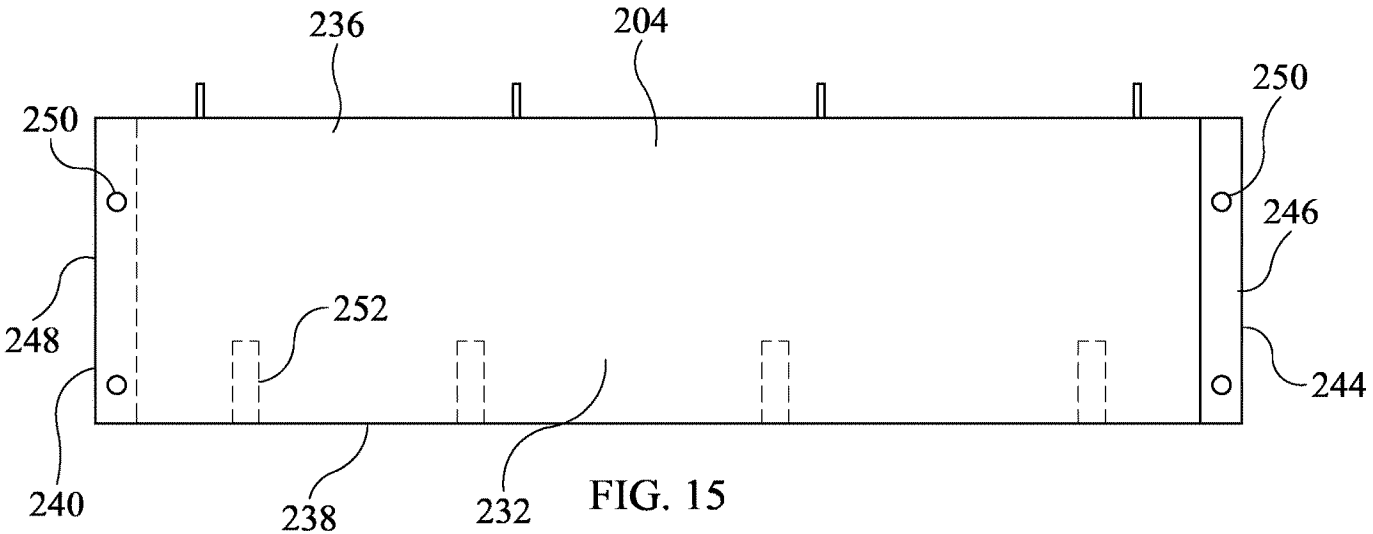
FIG. 15 is an exterior view of one embodiment of a tall gable riser panel member of the protective enclosure.
Figure 20:
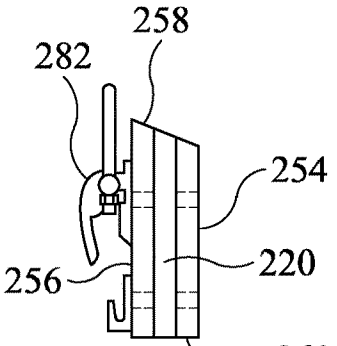
FIG. 20 is first end view of one embodiment of a short gable riser panel of the protective enclosure.
Figure 21:
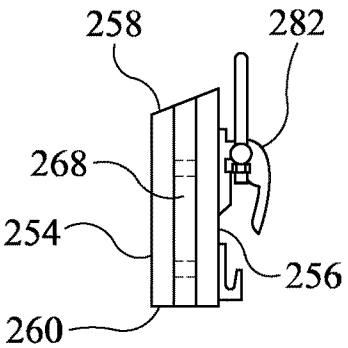
FIG. 21 is second end view of one embodiment of a short gable riser panel of the protective enclosure.
Figure 18:
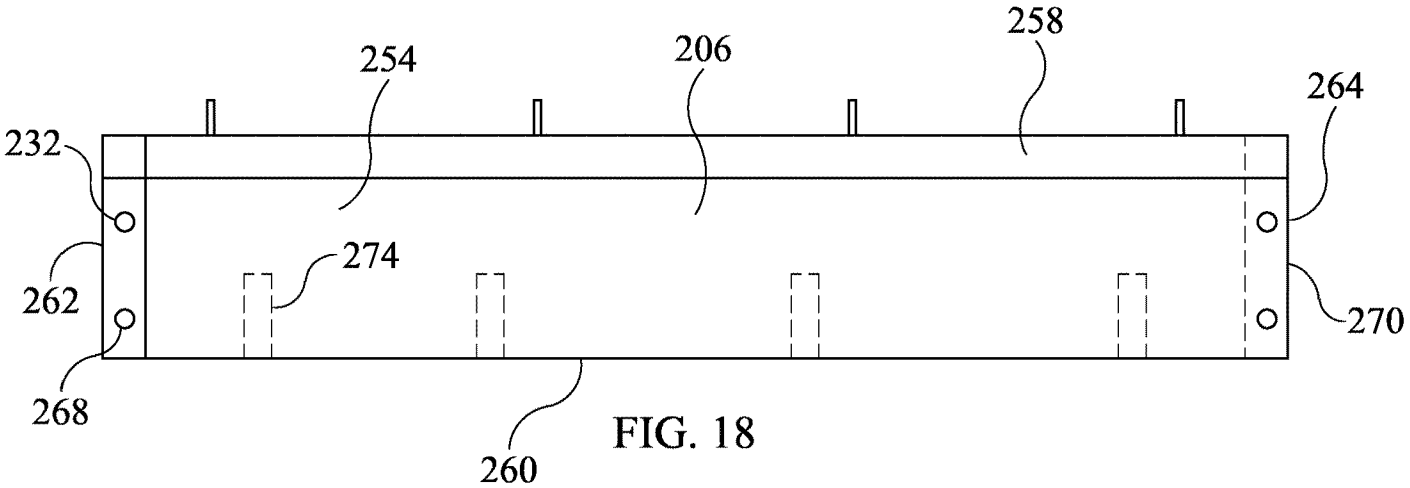
FIG. 18 is an interior view of one embodiment of a short gable riser panel member of the protective enclosure.
Figure 19:
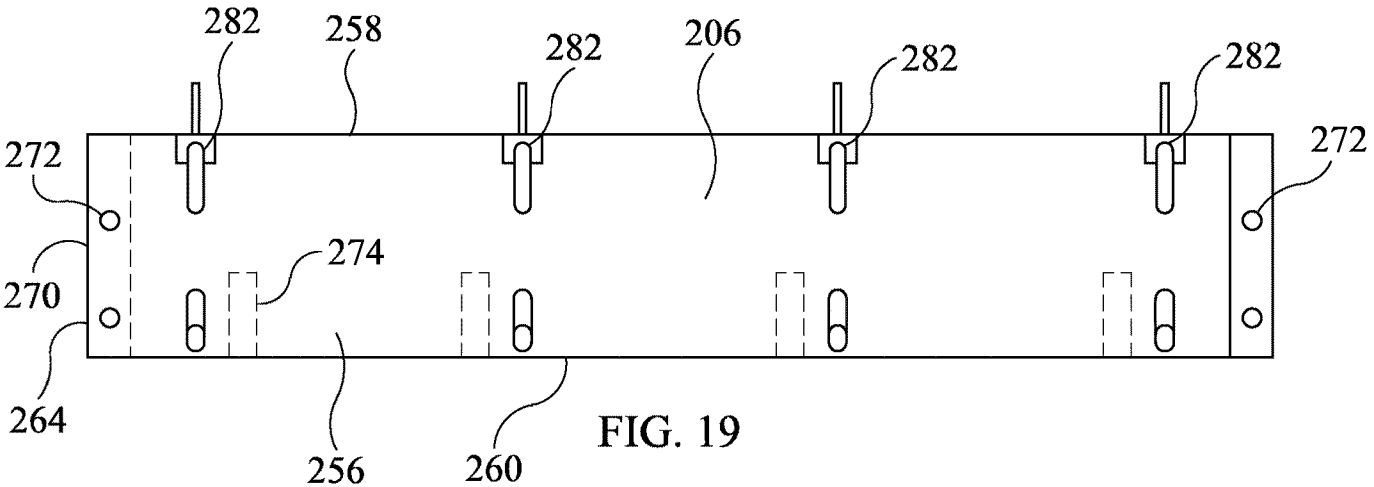
FIG. 19 is an exterior view of one embodiment of a short gable riser panel member of the protective enclosure.

In FIG. 11, the gable assembly 200 includes gable sidewall panel members 202, a tall gable riser panel member 204, a short gable riser panel member 206, and a plurality of gable corner connectors 208-214. In FIGS. 12 and 13, each of the gable sidewall panel members 202 have a top edge 216, a bottom edge 218 opposite the top edge, a tall side edge 220 extending between the top and the bottom edges, and a short side edge 222 substantially parallel to the tall side edge. The top edge 216 slopes downwardly in a direction from the tall side edge 220 to the short side edge 222 to provide a proper roof slope to the roof assembly 100 when connected to the gable assembly 200.

The tall side edge 220 has a tongue 224 and the short side edge 222 has a groove 226. The tongue and grooves 224 and 226 may include through holes 228 spaced therealong, respectively, for receiving bolts. gable sidewall panel member 202 may also include pin receiving holes 230 that are formed through the bottom edge 218, respectively.

With further reference to FIGS. 14-17, the tall gable riser panel member 204 may be a single member or comprised of two or more panel members 204 connected in a juxtaposed coplanar relationship. Similarly, the short gable riser panel member 206 may be a single member or comprised of two or more panel members 206 connected in a juxtaposed coplanar relationship.

Each tall gable riser panel member 204 includes a broad exterior side 232, a broad interior side 234 that is spaced from said broad exterior side defining a thickness therebetween, a first edge 236, a second edge 238 opposite said first edge, a third edge 240 substantially perpendicular to and extending between the first and the second edges, a fourth edge 244 opposite to and substantially parallel to the third edge, wherein the distance between the third edge and the fourth edge defines a predetermined length. The third edge 240 has a tongue 246 and the fourth edge 244 has a groove 248. The tongue and grooves 246 and 248 may include through holes 250 spaced therealong, respectively, for receiving bolts. Each tall gable riser panel member 204 may also include pin receiving holes 252 that are formed through second edge 238, respectively. The first edge 236 slopes downwardly in a direction from the exterior side 232 to the interior side 234 to provide a proper roof slope to the roof assembly 100 when connected to the gable assembly 200.

With reference to FIGS. 18-21, each short gable riser panel member 206 includes a broad exterior side 254, a broad interior side 256 that is spaced from said broad exterior side defining a thickness therebetween, a first edge 258, a second edge 260 opposite said first edge, a third edge 262 substantially perpendicular to and extending between the first and the second edges, a fourth edge 264 opposite to and substantially parallel to the third edge, wherein the distance between the third edge and the fourth edge defines a predetermined length. The third edge 262 has a tongue 268 and the fourth edge 264 has a groove 270. The tongue and grooves 268 and 270 may include through holes 272 spaced therealong, respectively, for receiving bolts. Each short gable riser panel member 206 may also include pin receiving holes 274 that are formed through second edge 260, respectively. The first edge 258 slopes downwardly in a direction from the interior side 256 to the exterior side 254 to provide a proper roof slope to the roof assembly 100 when connected to the gable assembly 200.

As best seen in FIG. 11, in the gable assembly 200, the gable sidewall panels 204 are disposed substantially parallel to one another at a spaced distance therebetween and at opposing wall sides. The tall gable riser panel 204 extends between the tall side edges 224 of the gable sidewall panels, and the short gable riser panel 206 is substantially parallel to the tall gable riser panel and extends between the short side edges 222 of the gable sidewall panels. Gable corner connector panel 210 connects the tall side edge 220 of one gable sidewall panel 202 to one edge of said tall gable riser panel 204 via connector plate 274. A second gable corner connector panel 212 connects the tall side edge 220 of the second gable sidewall panel 202 to a second edge of said tall gable riser panel 204. A third gable corner connector panel 214 connects the short side of one gable sidewall panel 204 to one edge of said short gable riser panel 206 via connector plate 276. A fourth gable corner connector panel 208 connects the short side edge 222 of the second gable sidewall panel 202 to a second edge of the short gable riser panel 206.

A plurality of gable assembly to roof panel assembly securing members are arranged to secure the roof assembly 100 to the gable assembly 200 in such a manner as to prevent separation in a plurality of directions. In the preferred embodiment securing members are toggle latches 280 that are arranged on the roof assembly 100 and the gable assembly 200 such that upon engagement, latches 280 releasably fasten the roof assembly to the gable assembly. Such a fastening system is described by U.S. Published Patent Application Number 20120073215, the entirety of which is incorporated herein by reference. Latches 280 include a latch 282 that is configured to engage a mating engagement feature 284 that the latch 282 is coupled with, FIG. 22.

In FIG. 2, enclosure 10 has a plurality of sidewall assemblies 300, 400, and 500 at predetermined sides of the enclosure with the adjoining vertical ends of the sidewall assemblies being connected by wall corner connector panels 600. Each of the sidewall assemblies 300, 400, and 500 including one or more sidewall panel members 602, 604, and/or 606*a* and 606*b* connected in a juxtaposed coplanar relationship. Sidewall panel members 602 are provided walls, panel members 604 are sidewall door panel members, and panel members 606*a* and 606*b* each include one-half portion of a cutout for allowing piping, such as, for example a pipeline to extend through the sidewall assembly.

It is important to note that the illustrated embodiment is only a representative embodiment of enclosure 10. All sidewall panel members may be replaced or exchange with any other sidewall panel member. For example, panel members 606*a* and 606*b* can be replaced by panel members 602 or 604. Further, while not shown, a sidewall panel member may be provided with a cutout solely formed through that panel member.

Figure 24:
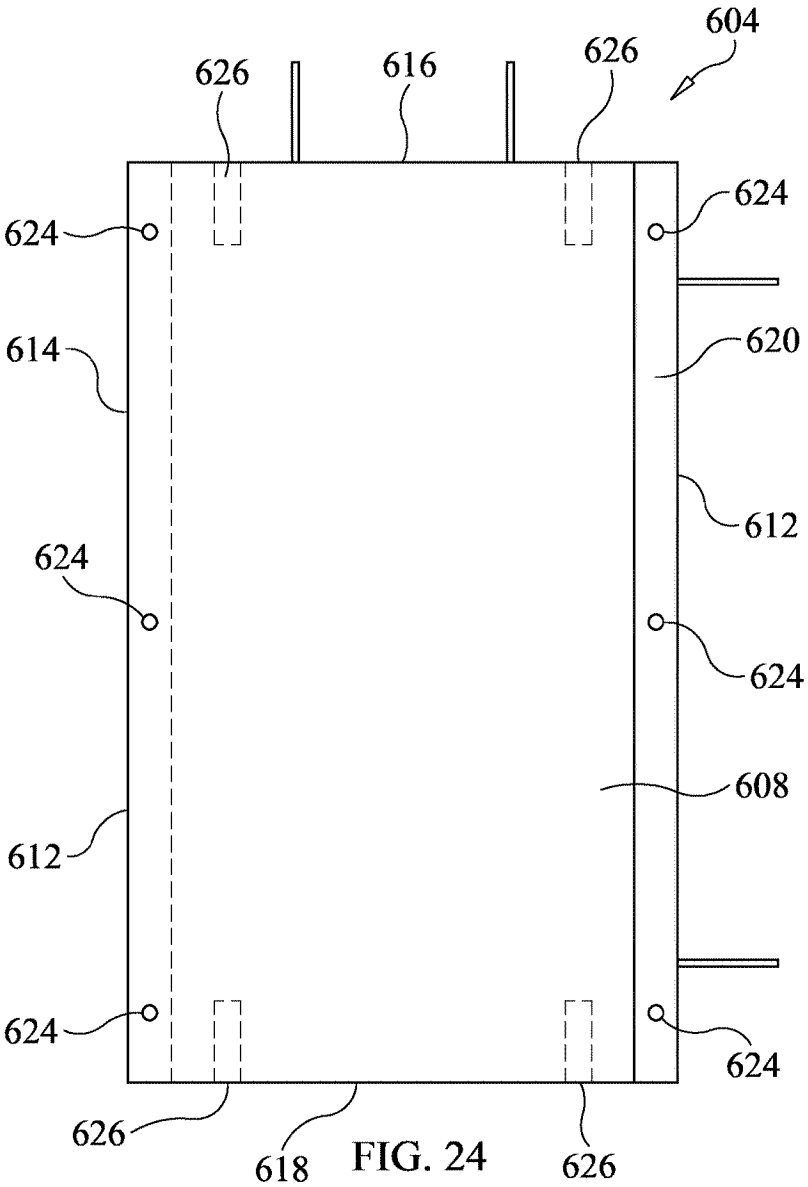
FIG. 24 is an exterior view of one embodiment of a sidewall panel member of the protective enclosure.
Figure 23:
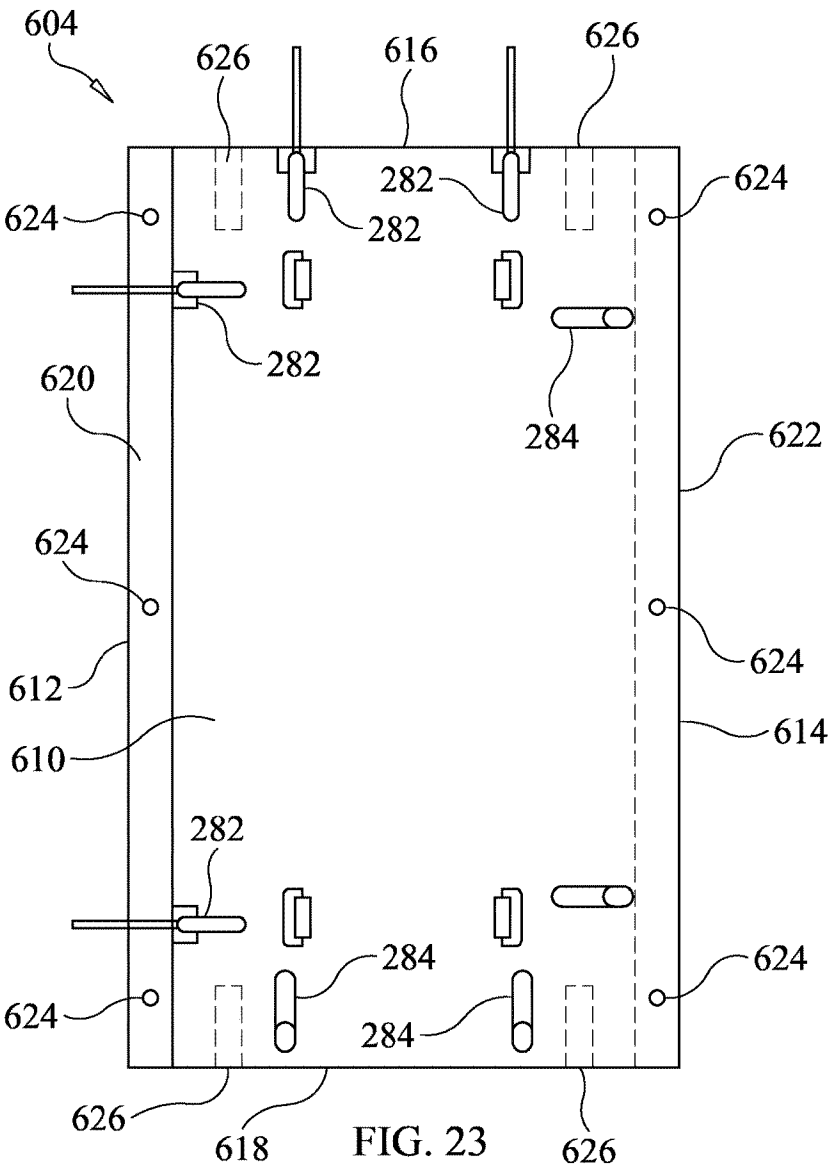
FIG. 23 is an interior view of one embodiment of a sidewall panel member of the protective enclosure.

In FIGS. 23-24, sidewall panel member 602 is shown and is representative of the general construction of each sidewall panel member of the enclosure system, such as, for example sidewall panel members 604 and 606*a*/606*b*. Each sidewall panel member 604 includes a broad exterior side 608, an broad interior side 610 that is spaced from said broad exterior side defining a thickness therebetween, a first edge 612, a second edge 614 opposite said first edge, a third edge 616 substantially perpendicular to and extending between the first and the second edges, a fourth edge 618 opposite to and substantially parallel to the third edge, wherein the distance between the third edge and the fourth edge defines a predetermined height. The first edge 612 has a tongue 620 and the second edge 614 has a groove 622. The tongue and grooves 620 and 622 may include through holes 624 spaced therealong, respectively, for receiving bolts. Each sidewall panel member 604 may also include pin receiving holes 626 that are formed through the third and fourth edges 616 and 618, respectively.

Sidewall panel members 602 that are arranged side-by-side in a juxtaposed coplanar relationship may be connected by the tongue 620 of one panel disposed within the groove 622 of the adjoining panel. The tongue 620 can be secured in the groove 622 by one or more bolts that is passed through cooperative holes 624 formed through the tongue and groove. This assembly is substantially the same as the roof panel members 102 as shown in FIG. 9 and does not require a separate figure here for understanding. Sidewall panel members 602 may be arranged end-to-end to increase the height of the enclosure. Sidewall panel members 602 that are arranged end-to-end in a juxtaposed coplanar relationship can be connected by one or more pins received by cooperating arranged pin receiving holes 626 through edges 618 and 620, respectively. This assembly is substantially the same as the roof panel members 102 as shown in FIG. 10 and does not require a separate figure here for understanding.

Figure 26:
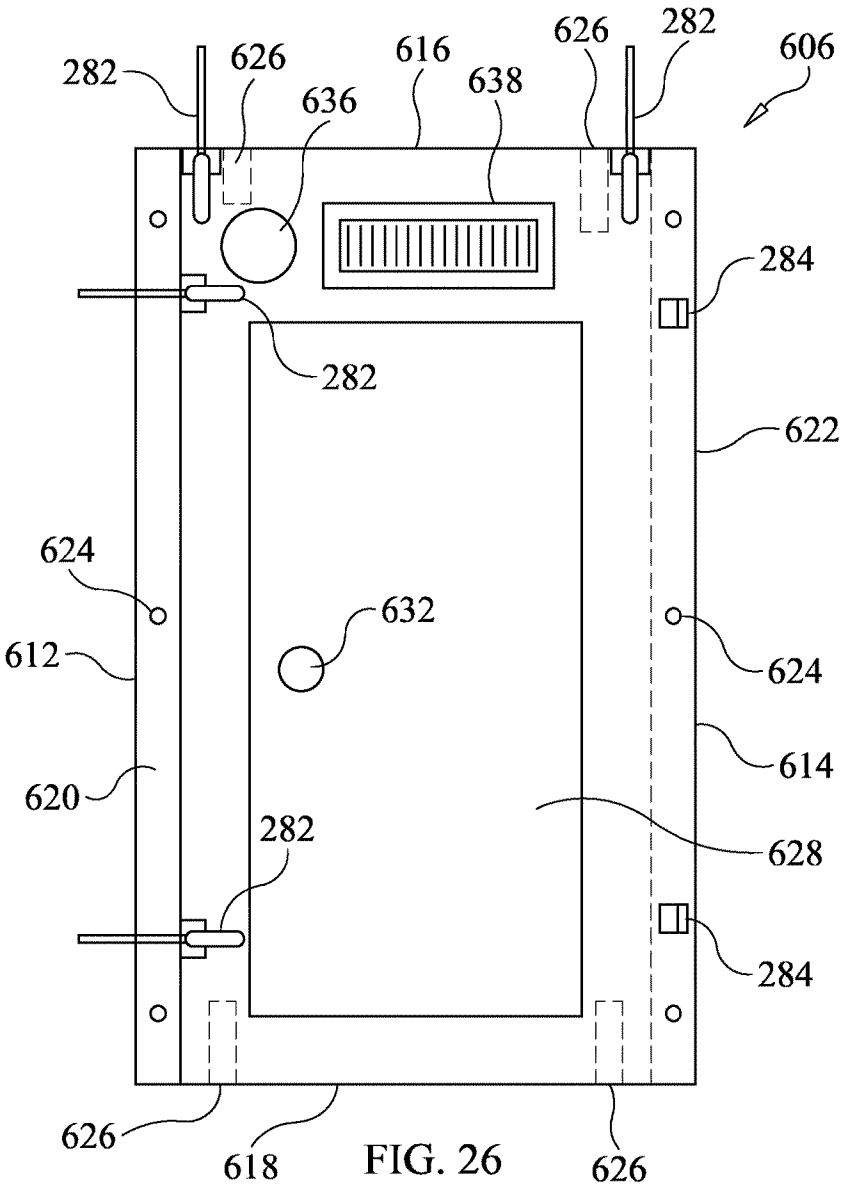
FIG. 26 is an interior view of one embodiment of a sidewall door panel member of the protective enclosure.
Figure 25:
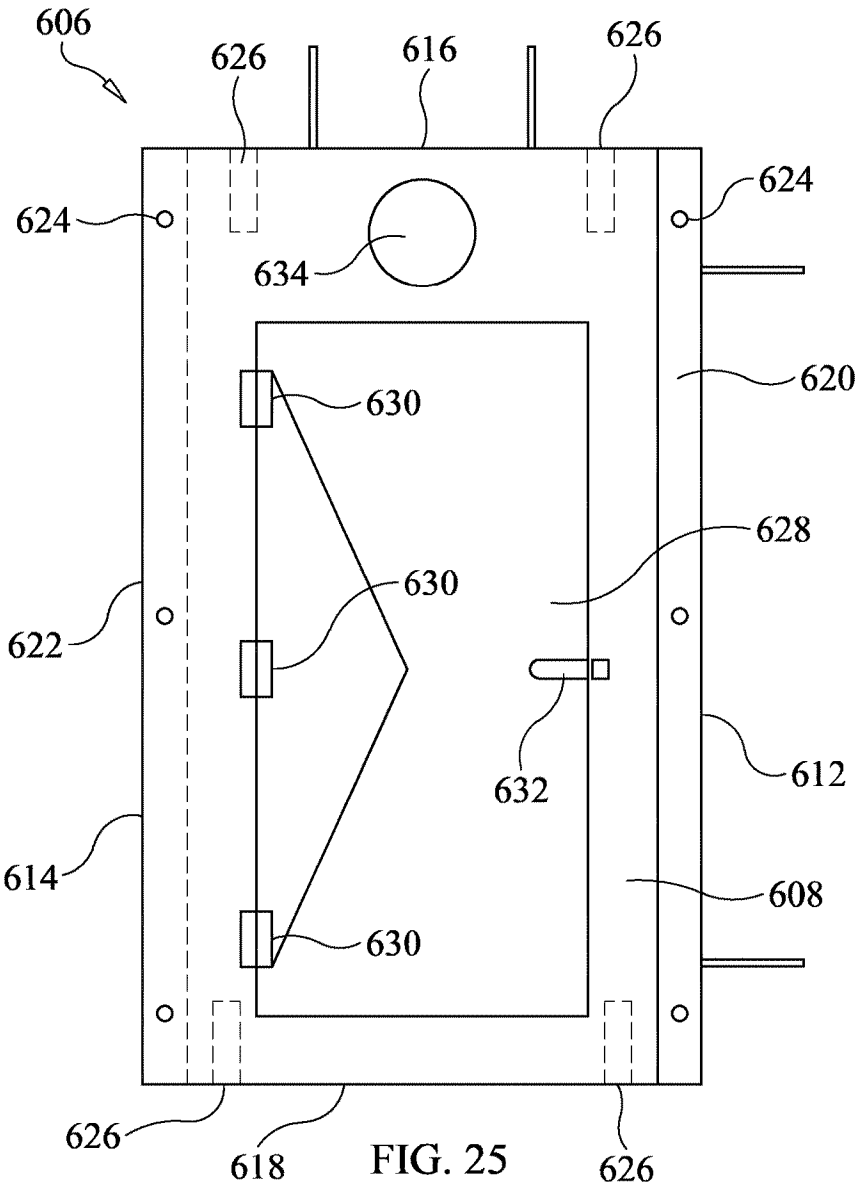
FIG. 25 is an exterior view of one embodiment of a sidewall door panel member of the protective enclosure.

In FIGS. 25 and 26, sidewall door panel members 604 have substantially the same overall construction as sidewall panel members 602 but include additional elements. Panel members 604 have a framed and hung door 628 that allows access to the interior of the enclosure 10. In a preferred embodiment, door 628 has spring-biased hinges 630 that bias the door into the closed position and a latch 632 that is like a walk-in freezer door latch. Panel members 604 further include an exterior light 634 and an interior light 636 for illuminating the area around the door, and which can be LED lights. Panel members 604 may further include a space heater 638 for heating the interior space of the enclosure. The lights 634, 636 and the space heater 638 may be powered by a portable generator not shown. In other embodiment, space heater 638 could be replaced for an air conditioner as desired.

In embodiments, and to satisfy certain regulations, enclosure 10 must have two or more sidewall door panel members 604 to provide two separate ways to enter and exit the enclosure. The door panel members 604 may be located directly across from one another in opposite sidewall assemblies or can be located at various wall locations as desired.

Figure 29:
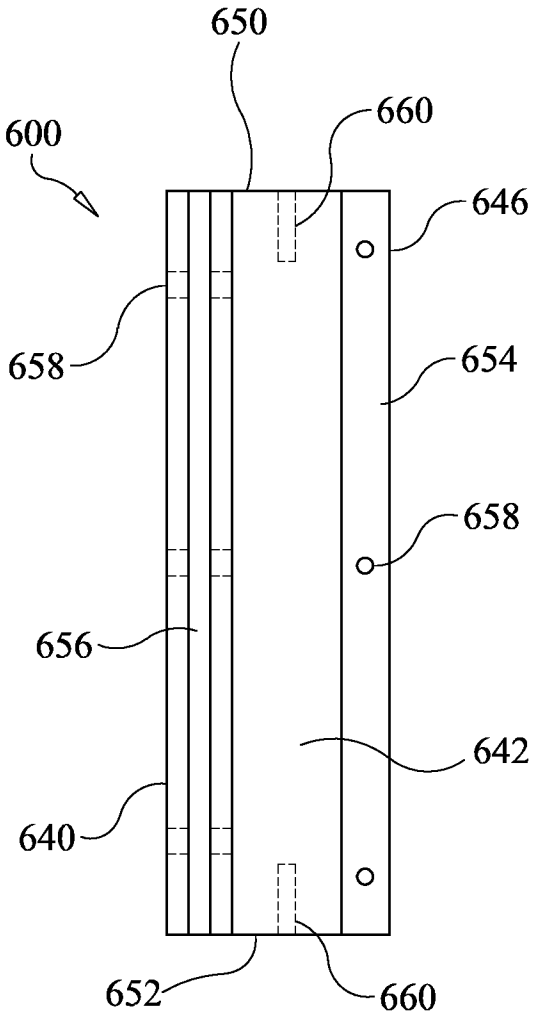
FIG. 29 is an end view of a wall corner connector panel of the protective enclosure.
Figure 28:
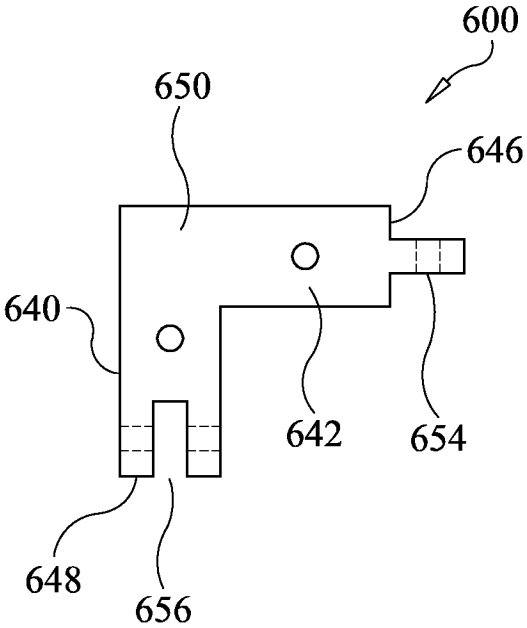
FIG. 28 is a top view of a wall corner connector panel of the protective enclosure.
Figure 27:
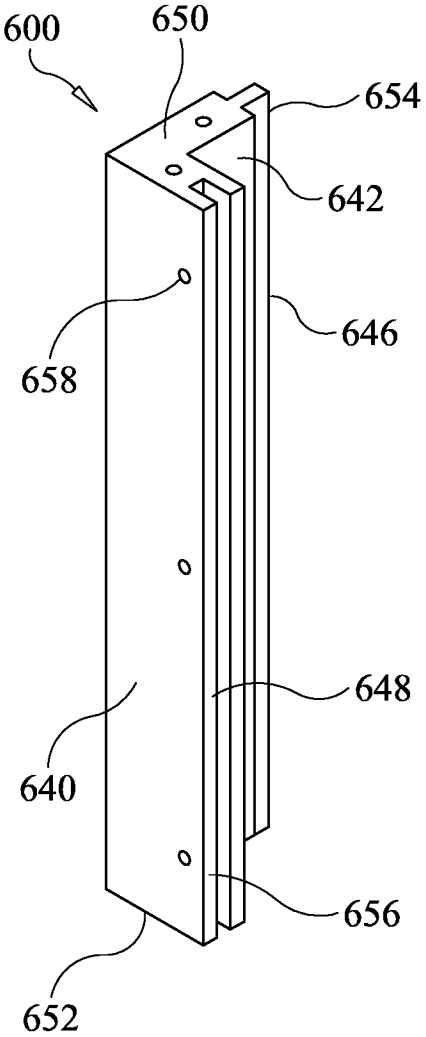
FIG. 27 is a perspective view of a wall corner connector panel of the protective enclosure.

In FIGS. 27-29, wall corner connector panels 600 are generally corner shaped having two vertical planar portions 640 and 642 arranged perpendicular to one another and having a thickness equal to the thickness of the sidewall panel members. Wall corner connector panels further include a first edge 646, a second edge 648 opposite said first edge, a third edge 650 substantially perpendicular to and extending between the first and the second edges, a fourth edge 652 opposite to and substantially parallel to the third edge, wherein the distance between the third edge and the fourth edge defines a predetermined height, equal to the sidewall panel height. The first edge 646 has a tongue 654 and the second edge 648 has a groove 656. The tongue and grooves 654 and 656 may include through holes 658 spaced therealong, respectively, for receiving bolts. Each wall corner connector panels 600 may also include pin receiving holes 660 that are formed through the third and fourth edges 650 and 652, respectively.

Figure 22:
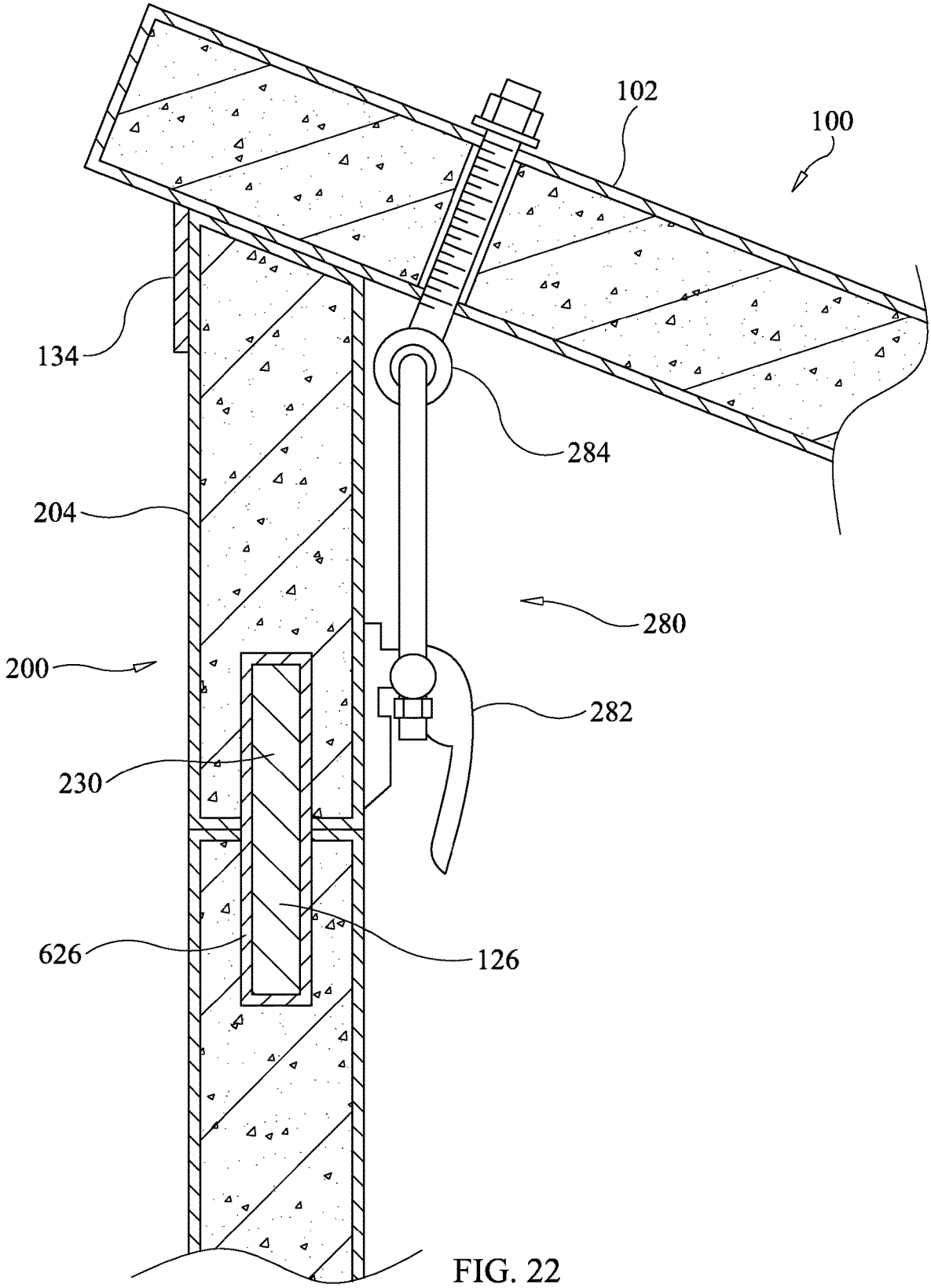
FIG. 22 is a partial cross-sectional view showing an engagement between the roof assembly and the gable assembly.
Figure 30:
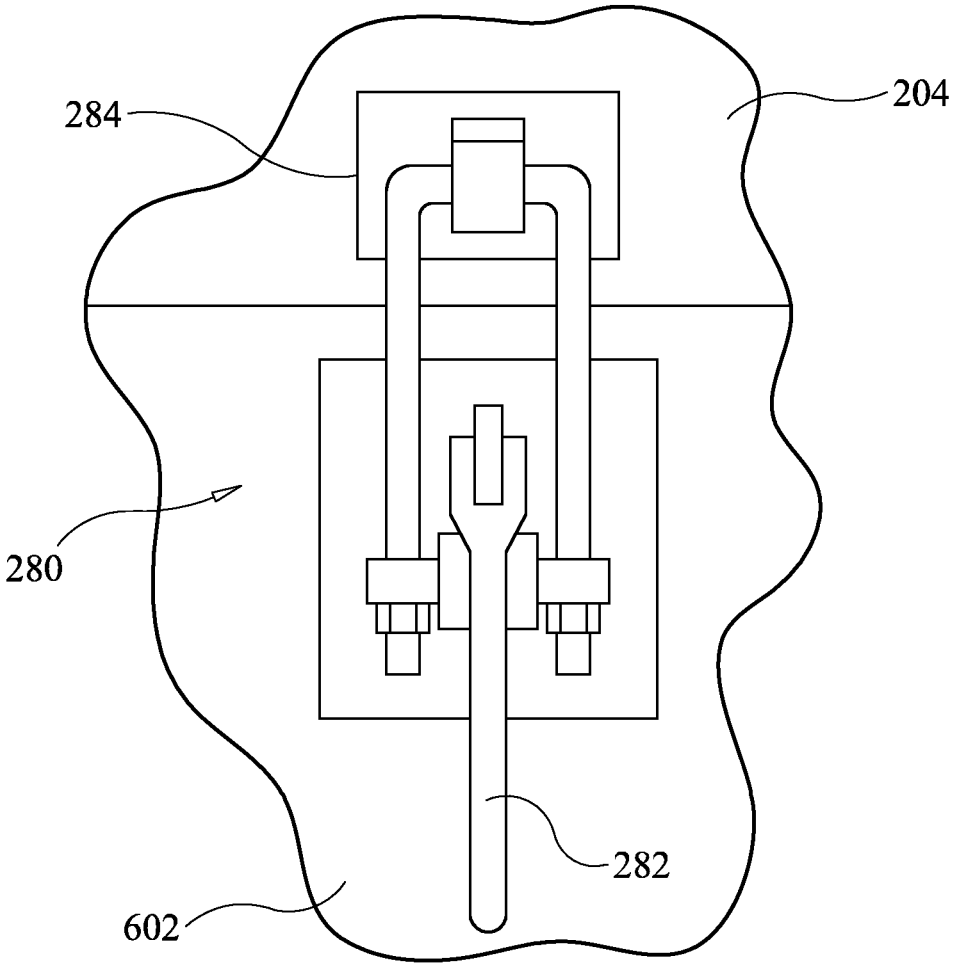
FIG. 30 is a view of a sidewall assembly to gable assembly securing member.

A plurality of sidewall assembly to gable assembly securing members are arranged to secure each sidewall assembly of the plurality of sidewall assemblies 300, 400, and 500 to the gable assembly in such a manner to prevent separation in a plurality of directions. In the preferred embodiment the securing members are toggle latches 280 there were described above, except member 284 is a J-hook as opposed to an eyebolt. One such securing member 280 is shown in FIG. 30, which illustrates a sidewall panel member 602 secured to a gable sidewall panel 204. Further, as shown in FIG. 22, a sidewall panel member 602 is shown further secured to a gable sidewall panel 204 with a pin 126 disposed in respective pin receiving holes 626 and 230. The remaining sidewall panel members are secured to the remaining panel members of the gable assembly with the same pin-in-hole connection.

Figure 31:
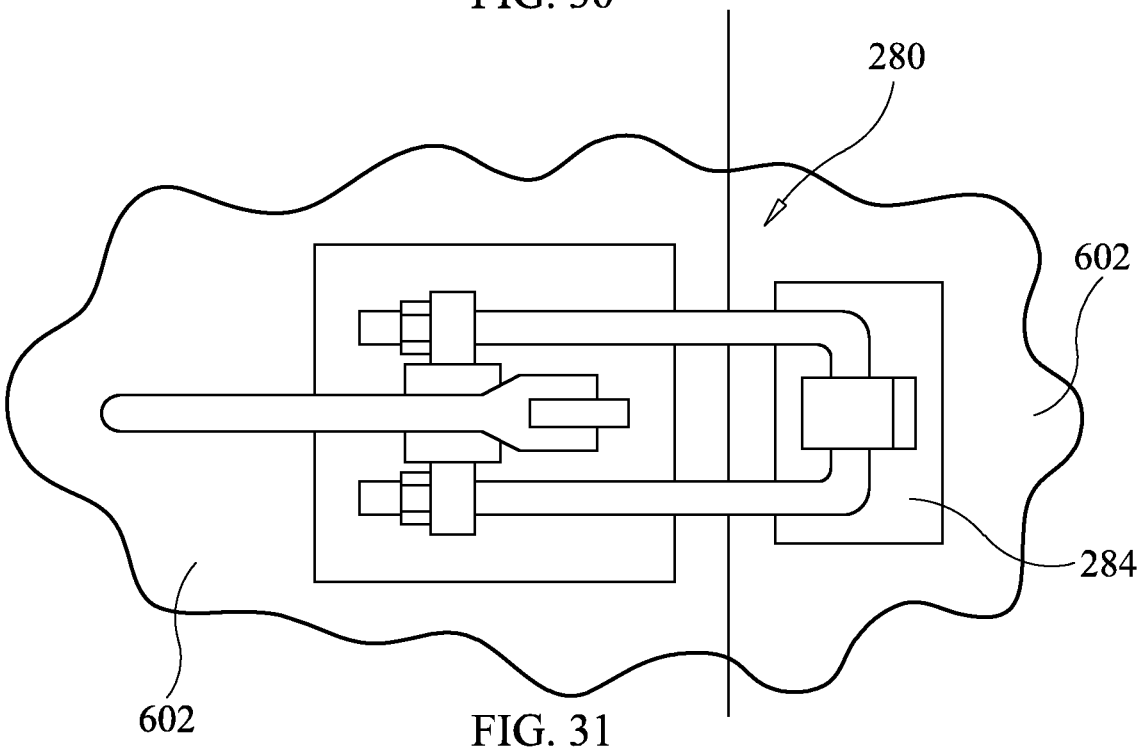
FIG. 31 is a view of a of sidewall-to-sidewall securing member.
Figure 32:
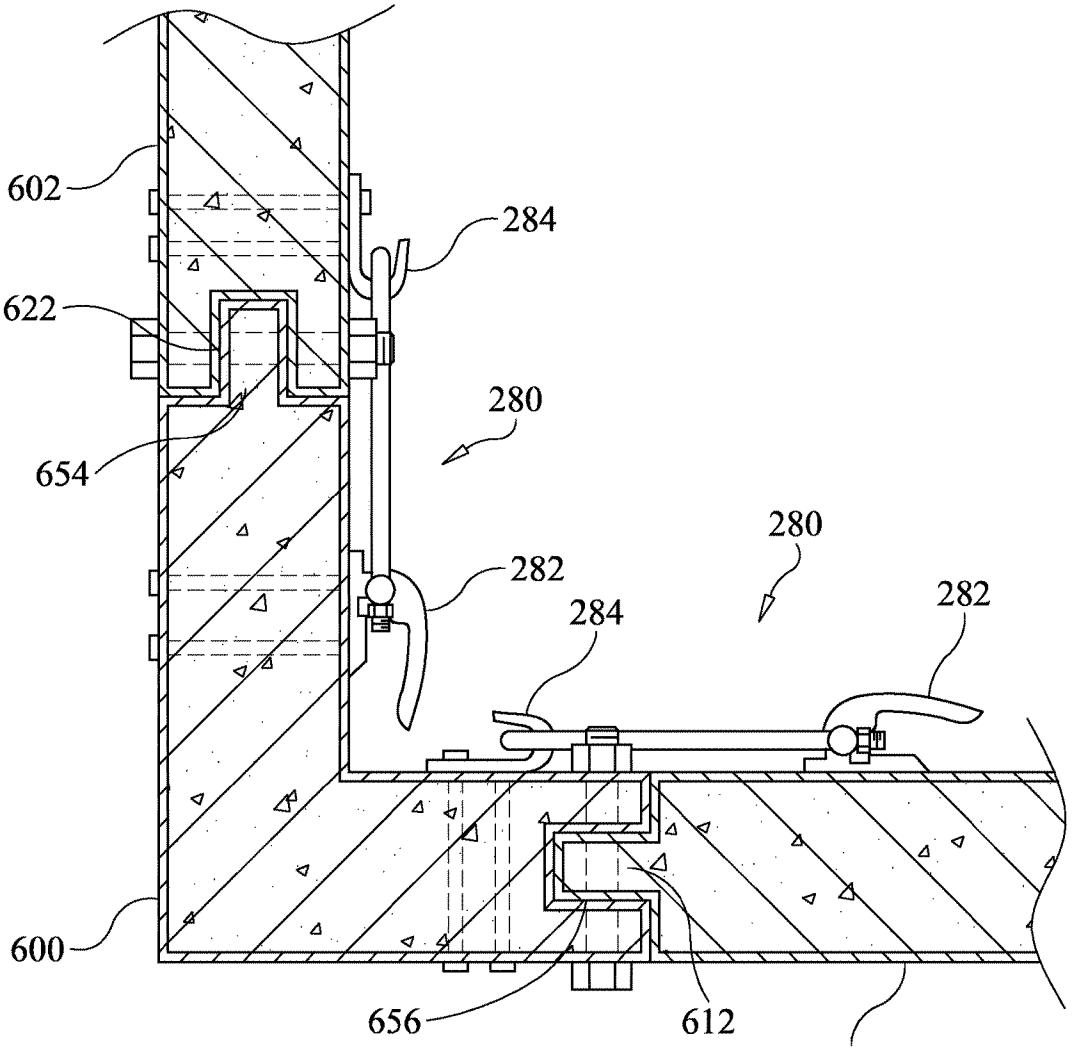
FIG. 32 is a cross-sectional view showing a wall corner connector panel connecting adjoining edges of two sidewall panel members.

A plurality of sidewall-to-sidewall securing members are arranged to secure juxtaposed sidewall panels or sidewall panels juxtaposed to wall corner connector panels in such a manner to prevent separation in a plurality of directions. In the preferred embodiment the securing members are toggle latches 280 there were described above, except member 284 is a J-hook as opposed to an eyebolt. One such securing member 280 is shown in FIG. 31, which illustrates a sidewall panel member 602 secured to a juxtaposed sidewall panel 602. In FIG. 32 there is shown a cross-section of two sidewall panel members 602 of separate different sidewall assemblies 300 and 400, for example, connected by a wall corner connector panel 600.

Figure 33:
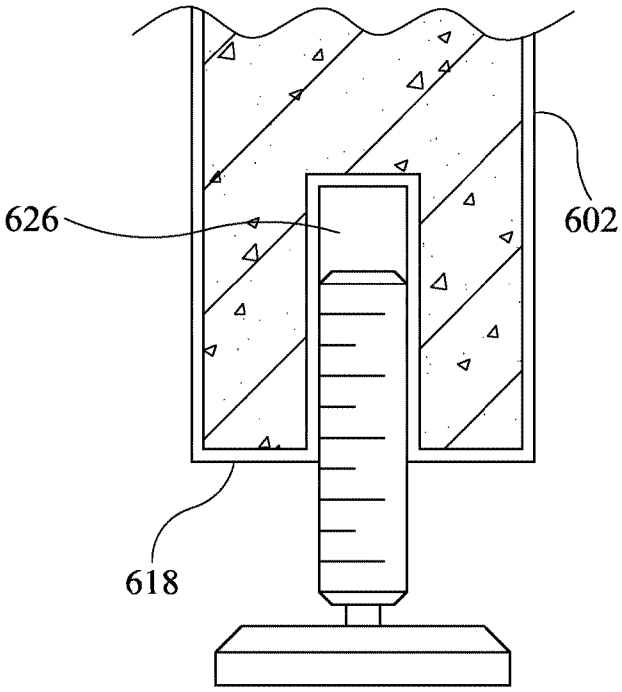
FIG. 33 is a cross-sectional view showing an adjustable foot located in a pin receiving hole through a bottom edge of a sidewall panel member.

In FIG. 33 there is shown a cross-section of a bottom of a sidewall panel member 602 showing that each sidewall panel member may have an adjustable foot 662 disposed in one or more pin holes 626 formed through edge 618 for leveling each the panel member. The corner connector panel members can also include the adjustable foot.

Figure 34:
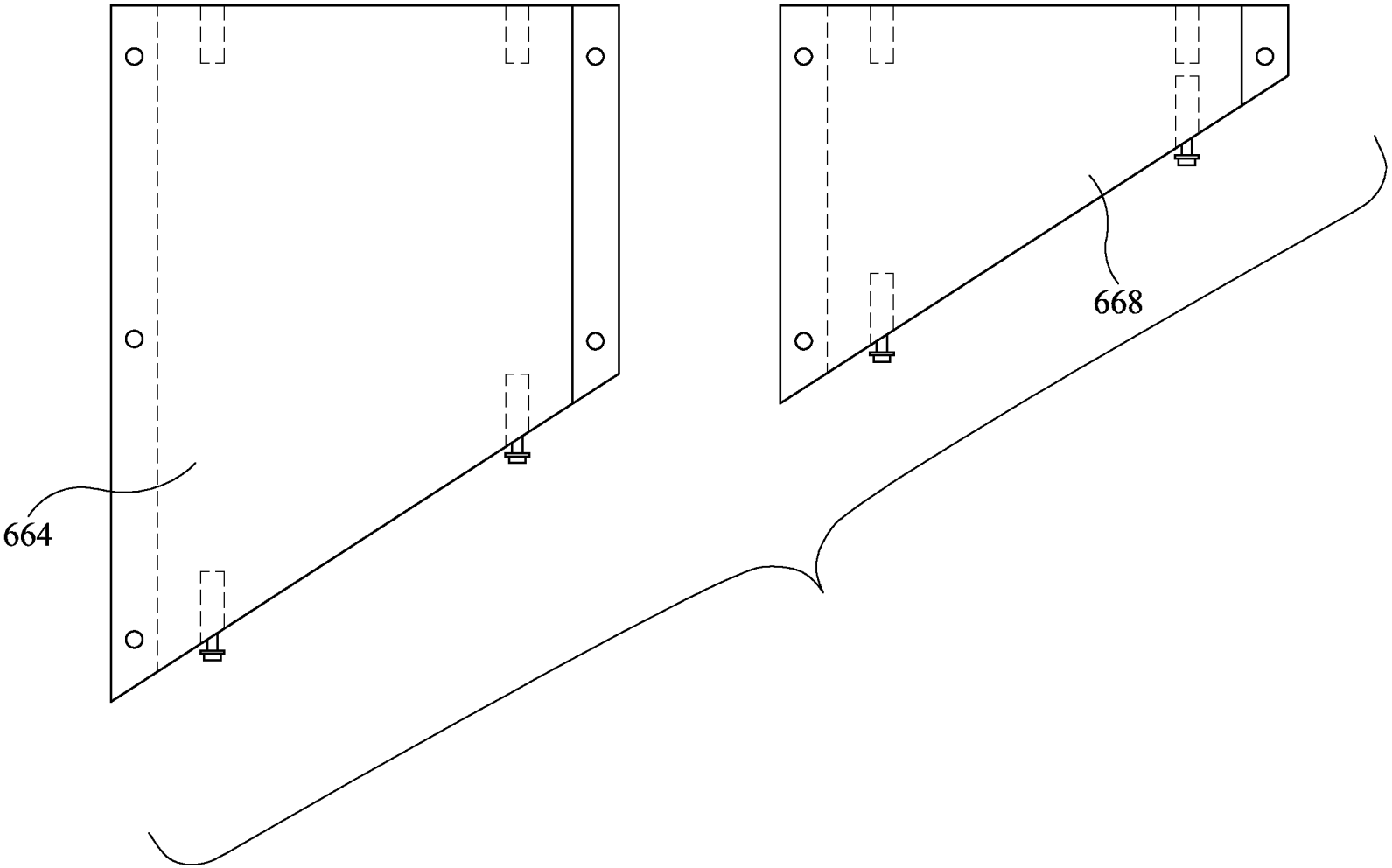
FIG. 34 is a side view of grade slope sidewall panel members.

In FIG. 34 there is shown sidewall panel members 664 and 668 that are used when the enclosure 10 is situated on a steep ground grade. Panel members 664 and 668 have a similar construction to that of sidewall panel members 602, except the fourth edge 670 tapers between the first and second edges 612 and 614. The angle of the taper can be customized for grades upon which the enclosure 10 is to be placed.

Further, while not shown, all or some of the panel members comprising the roof assembly 100, the gable assembly 200, and the sidewall assemblies 300, 400, and 500 can have rings, such as D-rings through which steel cable can be threaded and looped around a the equipment located within the enclosure to further anchor the enclosure against wind.

Figure 36:
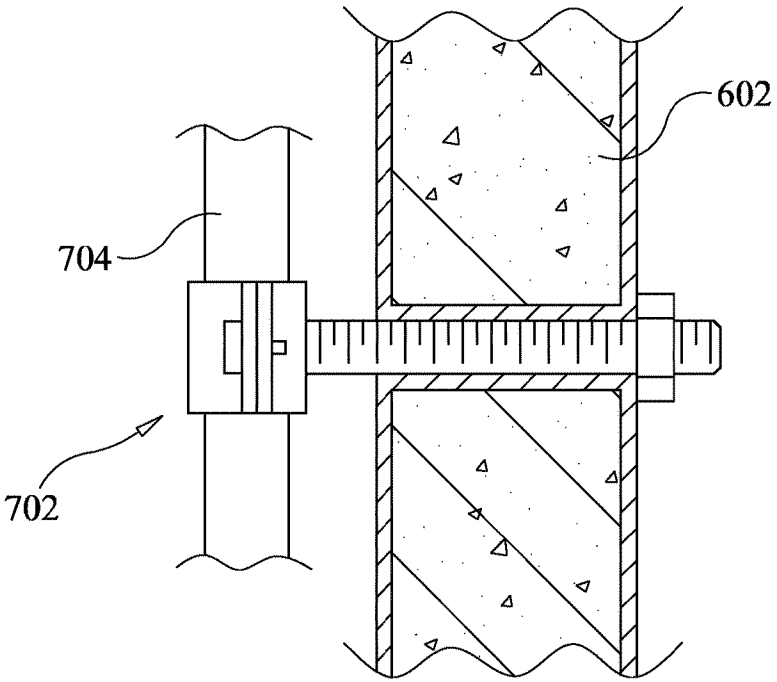
FIG. 36 is an illustrative, cross-section view showing a representative clamp for attaching a panel member to a scaffold.
Figure 35:
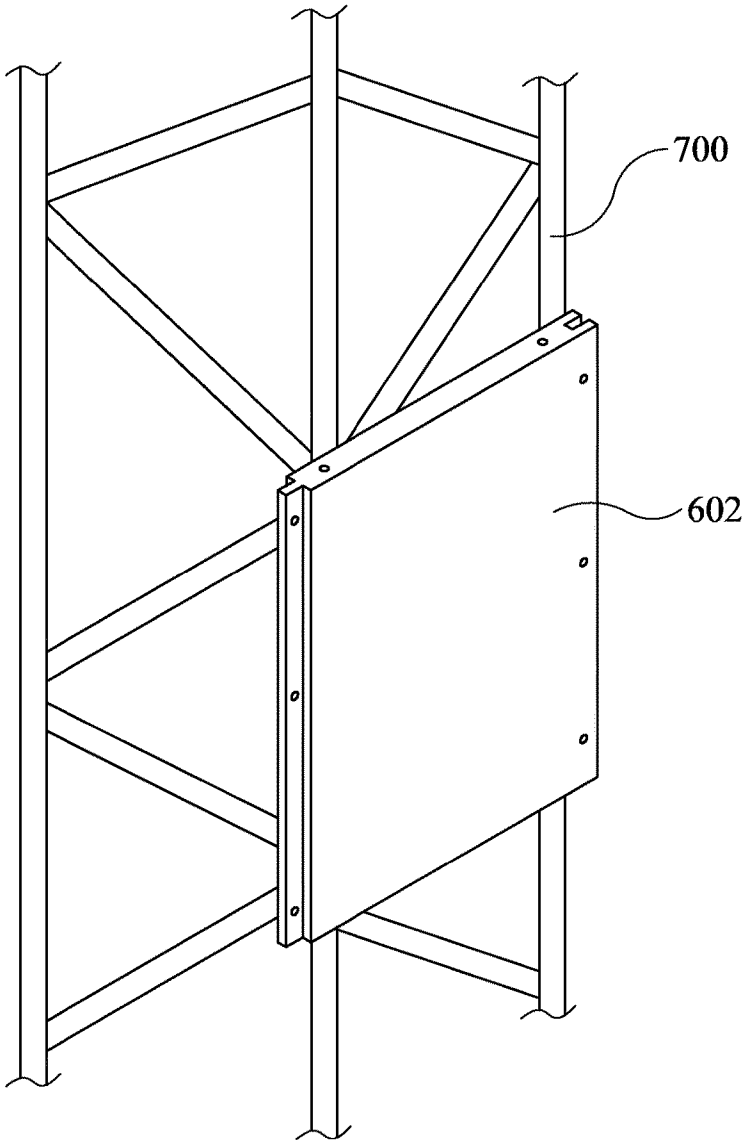
FIG. 35 is an illustrative perspective view showing a sidewall panel member attached to a scaffold.

Additionally, as representatively shown in FIGS. 35 and 36, any or all of the panel members comprising the roof assembly 100, the gable assembly 200, and the sidewall assemblies 300, 400, and 500 can be configured to attached to a scaffolding structure. For example, as representatively shown, sidewall panel member 602 is removably attached to scaffold 700 by panel to scaffold attaching members. The scaffolding attaching members are representatively shown as clamps, such as a bar clamp 702 that secures to a structural member 704 of the scaffold to secure the panel 602 to the scaffold. While only one clamp 702 is shown, many clamps may be used as desired to attach a panel member to the scaffold.

While the invention has been particularly shown and described with respect to the illustrated embodiments thereof, it will be understood by those skilled in the art that the foregoing and other changes in form and details may be made therein without departing from the spirit and scope of the invention.

What is claimed is:

1. A protective enclosure system using modular, metal structural panels having a rigid foam core, the system comprising:

a roof assembly for enclosing a top of the enclosure, said roof assembly including one or more roof panel members, wherein each roof panel member includes a broad exterior side, an broad interior side that is spaced from said broad exterior side defining a thickness therebetween, a first edge, a second edge opposite said first edge, a third edge substantially perpendicular to and extending between said first and said second edges, a fourth edge opposite to and substantially parallel to said third edge, wherein said distance between said third edge and said fourth edge defines a predetermined length, said first edge defining a groove extending therealong, said second edge defining a tongue extending therealong, and said roof assembly defining a perimeter having a plurality of wall sides;

a gable assembly including a pair of gable sidewall panels, a tall gable riser panel, a short gable riser panel, and a plurality of gable corner connector panels, each of said gable sidewall panels having a top edge, a bottom edge opposite said top edge, a tall side edge extending between said top and said bottom edges, and a short side edge substantially parallel to side tall side edge, said top edge sloping in a direction from said tall side edge to said short side edge;

wherein said pair of gable sidewall panels are disposed substantially parallel to one another at a spaced distance therebetween and at opposing wall sides, said tall gable riser panel extending between said tall side edges of said gable sidewall panels, and said short gable riser panel being substantially parallel to said tall gable riser panel and extending between said short side edges of said gable sidewall panels, one gable corner connector panel connecting said tall side edge of one gable sidewall panel to one edge of said tall gable riser panel, a second gable corner connector panel connecting said tall side edge of the second gable sidewall panel to a second edge of said tall gable riser panel, a third gable corner connector panel connecting said short side of one gable sidewall panel to one edge of said short gable riser panel, a fourth gable corner connector panel connecting said short side edge of the second gable sidewall panel to a second edge of said short gable riser panel;

a plurality of gable assembly to roof panel assembly securing members constructed and arranged to secure said gable assembly to said roof panel assembly in such a manner as to prevent separation in a plurality of directions;

a plurality of wall corner connector panels;

a plurality of sidewall assemblies at predetermined sides of said wall sides with the adjoining vertical ends of said sidewall assemblies being connected by said wall corner connector panels, wherein each of said sidewall assemblies including one or more sidewall panel members, wherein each of said sidewall panel members has a top edge, a bottom edge opposite said top edge, a left side edge and a right side edge, each substantially perpendicular to and extending between said top and said bottom edges, said left edge defining a tongue, and said right edge defining a groove;

a plurality of sidewall assembly to gable assembly securing members constructed and arranged to secure each sidewall assembly of said plurality of sidewall assemblies to said gable assembly in such a manner to prevent separation in a plurality of directions; and a plurality of sidewall-to-sidewall securing members constructed and arranged to secure juxtaposed sidewall panels or sidewall panels juxtaposed to wall corner connector panels in such a manner to prevent separation in a plurality of directions wherein each roof panel member further includes an elongated L-shaped hanger disposed on said interior broad side and along said third edge thereof, said L-shaped hanger configured to engage a longitudinal length of a top edge of said tall gable riser panel, a shiplap flange disposed on said exterior broad side and long said fourth edge thereof, a plurality of first through holes formed perpendicularly through and at spaced distances along said tongue thereof, a plurality of second through holes formed perpendicularly through and at spaced distances along said groove thereof, two or more first pin holes extending through said third edge thereof, and two or more second pin holes extending through said fourth edge thereof.

2. The protective enclosure system of claim 1, wherein at least one sidewall panel member of two or more sidewall assemblies are sidewall door panel members, each sidewall door panel member having a hinged door, a light attached to an exterior side of the sidewall door panel member, and a light attached to an interior side of the sidewall door panel member, and a space heater mounted to the interior side of the sidewall door panel member.

3. The protective enclosure system of claim 1, wherein one or more of the plurality of gable assembly to roof panel assembly securing members include a latch that is configured to engage a mating engagement feature to which the latch is coupled.

4. The protective enclosure system of claim 1, wherein one or more of the plurality of sidewall assembly to gable assembly securing members include a latch that is configured to engage a mating engagement feature to which the latch is coupled.

5. The protective enclosure system of claim 1, wherein one or more of the plurality of sidewall-to-sidewall securing members include a latch that is configured to engage a mating engagement feature to which the latch is coupled.

6. The protective enclosure system of claim 1, wherein said roof assembly includes two or more roof panel members secured together in a substantially juxtaposed, coplanar relationship.

7. The protective enclosure system of claim 1, wherein said plurality of sidewall assemblies includes two or more sidewall panel members secured together in a substantially juxtaposed, coplanar relationship.

8. The protective enclosure system of claim 1, wherein one or more of said roof panel members include a hole for a valve stem to extend through and a bristle-brush seal disposed within said hole.

9. The protective enclosure system of claim 1, wherein said plurality of sidewall assemblies include left and right sidewall assemblies, a front wall assembly, and a rear wall assembly.

10. The protective enclosure system of claim 1, wherein at least one sidewall panel member of each said front wall assembly and said rear wall assembly include one or more sidewall door panel members.

11. The protective enclosure system of claim 1, wherein one or more of said sidewall panel members have one or more pin holes formed through one or both of said top edge and said bottom edge of said sidewall panel member.

12. The protective enclosure system of claim 1, wherein said bottom edge of at least one sidewall panel member is tapered between said right and left side edges so as to permit the protective enclosure to be positioned on a sloped grade.

13. A protective enclosure system using modular, metal structural panels having a rigid foam core, the system comprising:

a roof assembly for enclosing a top of the enclosure, said roof assembly including one or more roof panel members, wherein each roof panel member includes a broad exterior side, an broad interior side that is spaced from said broad exterior side defining a thickness therebetween, a first edge, a second edge opposite said first edge, a third edge substantially perpendicular to and extending between said first and said second edges, a fourth edge opposite to and substantially parallel to said third edge, wherein said distance between said third edge and said fourth edge defines a predetermined length, said first edge defining a groove extending therealong, said second edge defining a tongue extending therealong, and said roof assembly defining a perimeter having a plurality of wall sides;

a gable assembly including a pair of gable sidewall panels, a tall gable riser panel, a short gable riser panel, and a plurality of gable corner connector panels, each of said gable sidewall panels having a top edge, a bottom edge opposite said top edge, a tall side edge extending between said top and said bottom edges, and a short side edge substantially parallel to side tall side edge, said top edge sloping in a direction from said tall side edge to said short side edge;

wherein said pair of gable sidewall panels are disposed substantially parallel to one another at a spaced distance therebetween and at opposing wall sides, said tall gable riser panel extending between said tall side edges of said gable sidewall panels, and said short gable riser panel being substantially parallel to said tall gable riser panel and extending between said short side edges of said gable sidewall panels, one gable corner connector panel connecting said tall side edge of one gable sidewall panel to one edge of said tall gable riser panel, a second gable corner connector panel connecting said tall side edge of the second gable sidewall panel to a second edge of said tall gable riser panel, a third gable corner connector panel connecting said short side of one gable sidewall panel to one edge of said short gable riser panel, a fourth gable corner connector panel connecting said short side edge of the second gable sidewall panel to a second edge of said short gable riser panel;

a plurality of gable assembly to roof panel assembly securing members constructed and arranged to secure said gable assembly to said roof panel assembly in such a manner as to prevent separation in a plurality of directions;

a plurality of wall corner connector panels;

a plurality of sidewall assemblies at predetermined sides of said wall sides with the adjoining vertical ends of said sidewall assemblies being connected by said wall corner connector panels, wherein each of said sidewall assemblies including one or more sidewall panel members, wherein each of said sidewall panel members has a top edge, a bottom edge opposite said top edge, a left side edge and a right side edge, each substantially perpendicular to and extending between said top and said bottom edges, said left edge defining a tongue, and said right edge defining a groove;

a plurality of sidewall assembly to gable assembly securing members constructed and arranged to secure each sidewall assembly of said plurality of sidewall assemblies to said gable assembly in such a manner to prevent separation in a plurality of directions;

a plurality of sidewall-to-sidewall securing members constructed and arranged to secure juxtaposed sidewall panels or sidewall panels juxtaposed to wall corner connector panels in such a manner to prevent separation in a plurality of directions;

wherein each roof panel member further includes an elongated L-shaped hanger disposed on said interior broad side and along said third edge thereof, said L-shaped hanger configured to engage a longitudinal length of a top edge of said tall gable riser panel, a shiplap flange disposed on said exterior broad side and long said fourth edge thereof, a plurality of first through holes formed perpendicularly through and at spaced distances along said tongue thereof, a plurality of second through holes formed perpendicularly through and at spaced distances along said groove thereof, two or more first pin holes extending through said third edge thereof, and two or more second pin holes extending through said fourth edge thereof;

wherein at least one sidewall panel member of two or more sidewall assemblies are sidewall door panel members, each sidewall door panel member having a hinged door, a light attached to an exterior side of the sidewall door panel member, and a light attached to an interior side of the sidewall door panel member, and a space heater mounted to the interior side of the sidewall door panel member;

wherein said roof assembly includes two or more roof panel members secured together in a substantially juxtaposed, coplanar relationship;

wherein said plurality of sidewall assemblies includes two or more sidewall panel members secured together in a substantially juxtaposed, coplanar relationship; and wherein one or more of said roof panel members include a hole for a valve stem to extend through and a bristle-brush seal disposed within said hole.

* * * * *